US011161167B2

(12) United States Patent
Michel

(10) Patent No.: US 11,161,167 B2
(45) Date of Patent: Nov. 2, 2021

(54) METHOD AND DEVICE FOR STACKING FLAT MATERIAL SHEETS, AND DEVICE AND SHEET METAL PRINTING MACHINE FOR PROCESSING AND/OR TREATING MATERIAL SHEETS IN THE FORM OF METAL SHEETS

(71) Applicant: KOENIG & BAUER METALPRINT GMBH, Stuttgart (DE)

(72) Inventor: Björn Michel, Stuttgart (DE)

(73) Assignee: KOENIG & BAUER METALPRINT GMBH, Stuttgart (DE)

( * ) Notice: Subject to any disclaimer, the term of this patent is extended or adjusted under 35 U.S.C. 154(b) by 0 days.

(21) Appl. No.: 16/486,857

(22) PCT Filed: Feb. 9, 2018

(86) PCT No.: PCT/EP2018/053300

§ 371 (c)(1),
(2) Date: Nov. 14, 2019

(87) PCT Pub. No.: WO2018/153695

PCT Pub. Date: Aug. 30, 2018

(65) Prior Publication Data

US 2020/0255249 A1 Aug. 13, 2020

(30) Foreign Application Priority Data

Feb. 21, 2017 (DE) ..... 10 2017 202 748.7
Feb. 21, 2017 (DE) ..... 10 2017 202 749.5

(51) Int. Cl.

| | |
|---|---|
| ***B21D 43/22*** | (2006.01) |
| ***B65H 31/10*** | (2006.01) |
| ***B65H 31/20*** | (2006.01) |
| ***B65H 33/08*** | (2006.01) |
| ***B21D 43/00*** | (2006.01) |
| ***B65H 31/36*** | (2006.01) |

(52) U.S. Cl.
CPC ..... *B21D 43/22* (2013.01); *B21D 43/00* (2013.01); *B65H 31/10* (2013.01); *B65H 31/20* (2013.01);
(Continued)

(58) Field of Classification Search
CPC .... B65H 31/10; B65H 31/36; B65H 2801/21; B65H 2301/42256
See application file for complete search history.

(56) References Cited

U.S. PATENT DOCUMENTS 3,217,902 A 11/1965 Bishop
4,478,403 A * 10/1984 Byrt ..... B65H 31/32 271/189
(Continued)

FOREIGN PATENT DOCUMENTS

DE 29820661 U1 2/1999
DE 19935665 A1 3/2001
(Continued)

OTHER PUBLICATIONS

International Search Report of PCT/EP2018/053300 dated Apr. 25, 2018.

*Primary Examiner* — Howard J Sanders
(74) *Attorney, Agent, or Firm* — Mattingly & Malur, PC

(57) ABSTRACT

Two-dimensional material sheets are stacked in a stacking device. One of a printing machine and a coating machine has at least one stacking unit having a stacking space. Material sheets are conveyed, via the stacking space of the stacking unit, comprised by the stacking device, and are deposited into a stack on top of one another on a loading aid. For two different production runs, the stacks are formed on the loading aid with the four corners of their areas in mutually different relative orientations with respect to the loading aid, which is arranged, in each case, in the stacking space of the stacking unit and is larger-format compared with the mate-
(Continued)

rial sheets to be deposited in each case. For the two production runs, in each case, one loading aid of the same format is positioned on different positions, as seen in projection in the horizontal, in the stacking space of the stacking unit.

7 Claims, 13 Drawing Sheets

(52) U.S. Cl.
CPC ..... *B65H 31/36* (2013.01); *B65H 33/08* (2013.01); *B65H 2301/42256* (2013.01); *B65H 2701/1732* (2013.01)

(56) References Cited

U.S. PATENT DOCUMENTS 5,011,126 A * 4/1991 Suzuki ..... B65H 1/263 271/159
5,672,045 A * 9/1997 Schmid ..... B65G 47/53 414/794.5
7,893,416 B2 * 2/2011 Dror ..... B65H 7/14 250/559.36
9,008,834 B2 4/2015 Forster
2010/0064921 A1 * 3/2010 Korolik ..... B65D 19/44 101/474
2010/0270737 A1 10/2010 Ichimura
2016/0004200 A1 * 1/2016 Taki ..... B65H 31/26 399/405

FOREIGN PATENT DOCUMENTS

DE 10100199 C1 5/2002
DE 10157098 B4 1/2003
DE 102014210109 A1 12/2014
DE 102016211623 A1 12/2016
EP 1072548 A2 1/2001
EP 1262435 A1 12/2002
EP 1424301 A1 6/2004
EP 1072548 B1 10/2005
JP 60-114157 U 8/1985

* cited by examiner

METHOD AND DEVICE FOR STACKING FLAT MATERIAL SHEETS, AND DEVICE AND SHEET METAL PRINTING MACHINE FOR PROCESSING AND/OR TREATING MATERIAL SHEETS IN THE FORM OF METAL SHEETS

CROSS REFERENCE TO RELATED APPLICATIONS

This application is the U.S. National Phase, under 35 U.S.C. § 371, of PCT/EP2018/053300, filed Feb. 9, 2018, published as WO 2018/153695 A1 on Aug. 30, 2018 and claiming priority to DE 10 2017 202 749.5, filed Feb. 21, 2017 and to DE 10 2017 202 748.7, also filed Feb. 21, 2017, the disclosures of which are expressly incorporated herein in their entireties by reference.

FIELD OF THE INVENTION

The present invention relates to a method and a device for stacking flat material sheets and to a device and a sheet metal printing machine for processing and/or treating material sheets in the form of metal sheets. A method is provided for stacking flat material sheets in a stacking device, in particular in a stacking device that is part of one of a printing and a coating machine. The stacking device comprises at least one pile delivery that has a stacking space. Material sheets are conveyed above the stacking space of the pile delivery, which is part of the stacking device, and are deposited one on top of the other on a loading aid to form a pile. The material sheets are conveyed on an intake side, above the stacking space of the pile delivery that is part of the stacking device. The device for stacking the flat material sheets, in particular for stacking the flat material sheets in the one of a printing machine and a coating machine, includes the at least one pile delivery with the stacking space, above which incoming material sheets can be conveyed by a conveyor system and can be deposited there, one on top of the other, to form a pile. A pile carrier is movable vertically within the stacking space. A stop means for aligning the material sheets flush along an upstream pile side, during pile formation, along with the stop means for aligning the material sheets flush along a downstream pile side, during pile formation, are provided. The upstream stop means is mounted, fixed relative to the frame, along a direction of transport under operating conditions. The downstream stop means is adjustable along the transport direction under operating conditions, for the purpose of adjusting for the stacking of difference material format lengths. Above the stacking space, a conveyor system, which is embodied as an overhead transport system for conveying the material sheets, is provided. A length of the vertically movable pile carrier is greater, as viewed in the transport direction, than a fixed or maximum distance to be set under operating conditions between the upstream and the downstream stop means for deposition. A loading plane of the vertically movable pile carrier, as viewed in the transport direction, protrudes, on at least the upstream side, between a vertical alignment of the stop surface of a stop means that is used for aligning the material sheets flush along the upstream pile side during pile formation.

BACKGROUND OF THE INVENTION

From DE 199 35665 A1 and EP 1072548 B1, a device for stacking flat goods, in particular metal sheets, is known, in which the metal sheets are conveyed overhead above a stacking space, where they are dropped, one on top of the other, flush between a front edge stop and a rear edge stop on a lifting table to form a pile.

EP 1 262 435 A1 relates to a method and a device for stacking raw material, in particular paper sheets, in which an auxiliary pile carrier that covers the entire width of the shaft can be introduced horizontally into the stacking space at the pile delivery. Each new pile is started on said auxiliary pile carrier as an auxiliary pile, and thereafter is delivered to a pallet positioned beneath it.

WO 2012/072699 A2 relates to the formation of multiple piles of sheets, in particular transformer sheets, which have been cut out, for example, in a cutting and punching apparatus. To enable a plurality of the cut-out sheets to be deposited in a defined manner side by side in multiple piles, stop elements are provided, which guide the sheets laterally as they are being deposited. The lateral stop elements can be adjusted horizontally to adjust the target positions, but are mounted at a fixed height. DE 25 51 497 C3 also relates to a stacking of transformer sheets for use in manufacturing transformers.

WO 2017/001398 A2 relates to stacking at the end of a sheet-fed printing press, with a downstream stop aligning the pile flush with the corresponding pallet edge.

From U.S. Pat. No. 3,217,902 A, a device for forming multiple piles is known, in which drive means are used to position a pallet along the transport direction within the stacking space. A stop plate that can be adjusted in the transport direction using a hand wheel and that cooperates with the pallet for positioning of the same is provided.

JP S60 114157 U discloses a stacking device in which a loading aid that receives the pile is introduced from the side into the stacking space against a stop. At the pile formation level, a sheet front stop that can be adjusted for the sheets along the transport direction, along with a sheet rear stop that can adjusted for the sheets along the transport direction is provided. The sheet stops are mounted vertically movable on the frame.

EP1 424 301 A1 relates to a stacking device for stacking paper sheets that have been cross-cut from webs, in which stacking is to be possible in a non-stop operation. For this purpose, a vertically movable main pile board is provided, along with a two-part auxiliary pile board, on which an auxiliary pile can be formed while the main pile is being removed. The position of the pallet arranged on the main pile board is adjusted and fixed in place by means of pallet fixing bars. Normally, a pallet that is somewhat larger that the sheet format is used in order to prevent later damage to the lower pile edges by the overhang of the pallet.

DE 10 2014 210 109 A1 discloses a stacking device for a non-stop pile change, in which a known, in which an auxiliary pile carrier can be moved along with the rear edge stop in the transport direction for a smaller sheet format.

DE 101 22 199 C1 discloses an additional non-stop pile change device, US 2010/0270737 A1 discloses a stacking space that can be accessed by the stacking device on one of three sides, DE 10 2016 211 623 A1 discloses a dual-stream stacking device, and DE 298 20 661 U1 discloses a device for aligning pile carriers along the machine center in the feeder or the delivery of sheet-fed printing machines.

SUMMARY OF THE INVENTION

The object of the present invention is to provide a method and a device for stacking flat material sheets, along with a device and sheet metal printing machine for processing and/or treating material sheets in the form of metal sheets.

The object of the present invention is attained, according to the invention, in that for two different production runs, the piles are formed in the loading aid with the four corners of their main surface area arranged in mutually different positions relative to the loading aid, which, in each case, is arranged within the stacking space of the sheet delivery and is larger, in format, than the material sheets to be deposited in each case. For each of the two production runs, a loading aid of the same format is positioned at a different location within the stacking space of the pile delivery, as viewed in the horizontal projection. Before a new pile is formed, a loading aid that is larger, in format, than the material sheets to be deposited in each case is positioned within the stacking space. Once the loading aid has been positioned horizontally for the subsequent pile formation, in at least one production situation, the loading aid is moved vertically upward, at least until the region of its upper surface is in physical contact with the lower edge of a stop means that is used to align the material sheets of the pile flush along the upstream pile side during pile formation. On the pile carrier, the loading aid is positioned, and on which the pile to be formed is received. A positioning aid, having one or more alignment aids that serve to position the loading aid in the transport direction, is provided, which positioning aid can be used to define the location of the loading aid in a first position. A downstream edge of the loading aid is aligned vertically with the downstream stop means or is offset, in particular upstream, at most slightly, by up to 20 mm, as viewed along the transport direction, and in a location, in a second position, in which the upstream edge of the loading aid is aligned vertically with the upstream stop means or is offset, in particular downstream, at most slightly by up to 20 mm, as viewed along the transport direction.

The advantages to be achieved by the invention consist, in particular, in that piles can be formed in variable positions on a loading aid, in particular a pallet. In particular, they can at least be either substantially flush along a front edge of the loading aid with respect to the material sheets entering the stacking space, i.e., the edge that is further downstream, or substantially flush along a rear edge of the loading aid with respect to the material sheets entering the stacking space, i.e., the edge that is further upstream. Advantageously, this can be accomplished without the substantial effort that would be associated with varying the deposition location, for example.

This is preferably achieved in that in the stacking device, in which material sheets are conveyed above the stacking space of a pile delivery, which is part of the stacking device, and are deposited one on top of the other on a loading aid to form a pile, for two different production runs, the piles are formed on the loading aid with the four corners of their main surface area in mutually different positions relative to said loading aid, which in each case is arranged within the stacking space of the pile delivery and which is larger in format than the material sheets to be deposited in each case, in that for each of the two production runs, a loading aid of the same format is positioned at a different location within the stacking space of said pile delivery, as viewed in the horizontal projection. Preferably, for the two different production runs, the piles are formed flush, at least substantially, along edges that lie on different sides of the loading aid, which is larger in format than the material sheets to be deposited in each case.

A preferred device that is suitable for this purpose, in particular, comprises at least one pile delivery that has a stacking space, above which incoming material sheets can be conveyed by means of a conveyor system and where said sheets can be deposited one on top of the other to form a pile, and also comprises a pile carrier that is movable vertically within the stacking space, wherein a stop means is provided, which aligns the material sheets flush along the upstream pile side during pile formation, along with a stop means that aligns the material sheets flush along the downstream pile side during pile formation, and wherein a loading aid, on which the pile to be formed can be received, can be positioned on the pile carrier, and wherein a positioning aid is provided, which has one or more alignment aids that are used for positioning the loading aid in the transport direction, and which can be used to define a location of the loading aid in a first position in which the downstream edge of said loading aid is aligned vertically with the downstream stop means, or is offset at most slightly, i.e. by up to 20 mm, as viewed along the transport direction, in particular upstream, and a location in a second position, in which the upstream edge of the loading aid is aligned vertically with the upstream stop means, or is offset at most slightly, i.e. by up to 20 mm, as viewed along the direction of transport, in particular downstream.

Independently of the above, in principle, but advantageously also in conjunction therewith, during the stacking of flat material sheets in a stacking device, which is preferably part of a printing and/or coating machine, material sheets are preferably conveyed on the intake side above a stacking space of a pile delivery that is part of the stacking device, and are deposited one on top of the other on a loading aid to form a pile, wherein before a new pile is formed, a loading aid that is larger in format than the material sheets to be deposited in each case is positioned within the stacking space, and once the loading aid has been positioned horizontally, the loading aid is moved vertically upward for the subsequent pile formation, at least until the region of its upper surface comes into physical contact with the lower edge of at least one stop means that is used for aligning the material sheets of the pile during pile formation in a flush alignment along at least one pile side, in one operating mode the front pile side, in particular, and/or in another operating mode, the rear pile side. Preferably, said loading aid is moved upward at least until it raises the at least one stop means at least slightly in relation to the position it occupied previously in the contact-free state.

A preferred device for stacking flat material sheets, which is suitable, in particular, for the above and/or which is part of a printing and/or coating machine, comprises at least one pile delivery that has a stacking space, above which incoming material sheets can be conveyed by a conveyor system and where said sheets can be deposited one on top of the other to form a pile, and comprises a pile carrier that is movable vertically within the stacking space, wherein a stop means that is used for aligning the material sheets flush along the upstream pile side during pile formation is provided, along with a stop means that is used for aligning the material sheets flush along the downstream pile side during pile formation, and wherein a loading aid, on which the pile to be formed can be received, can be positioned on the pile carrier. A loading plane of the vertically movable pile carrier, intended for receiving the loading aid, has a greater length, as viewed in the transport direction, than a fixed or maximum distance to be set, under operating conditions, between the upstream stop means and the downstream stop means for sheet deposition. In place of or in addition to this, the support plane of the vertically movable pile carrier that supports the loading aid protrudes, at least on the upstream side as viewed in the direction of transport, significantly, i.e., by at least 50 mm and/or by at least one-tenth the length of the fixed or maximum distance to be set during operation between the upstream stop means and the downstream stop means for deposition, beyond the vertical alignment of the stop surface of a stop means that is used for aligning the material sheets flush along the upstream pile side during pile formation.

Individual or multiple refining features, as set forth in the embodiments and variants of the following embodiments and/or in the dependent claims, may be added to the features of the aforementioned embodiments.

BRIEF DESCRIPTION OF THE DRAWINGS

Exemplary embodiments of the invention are illustrated in the set of drawings and will be described in greater detail below.

In the drawings.

DESCRIPTION OF PREFERRED EMBODIMENTS

Figure 1:
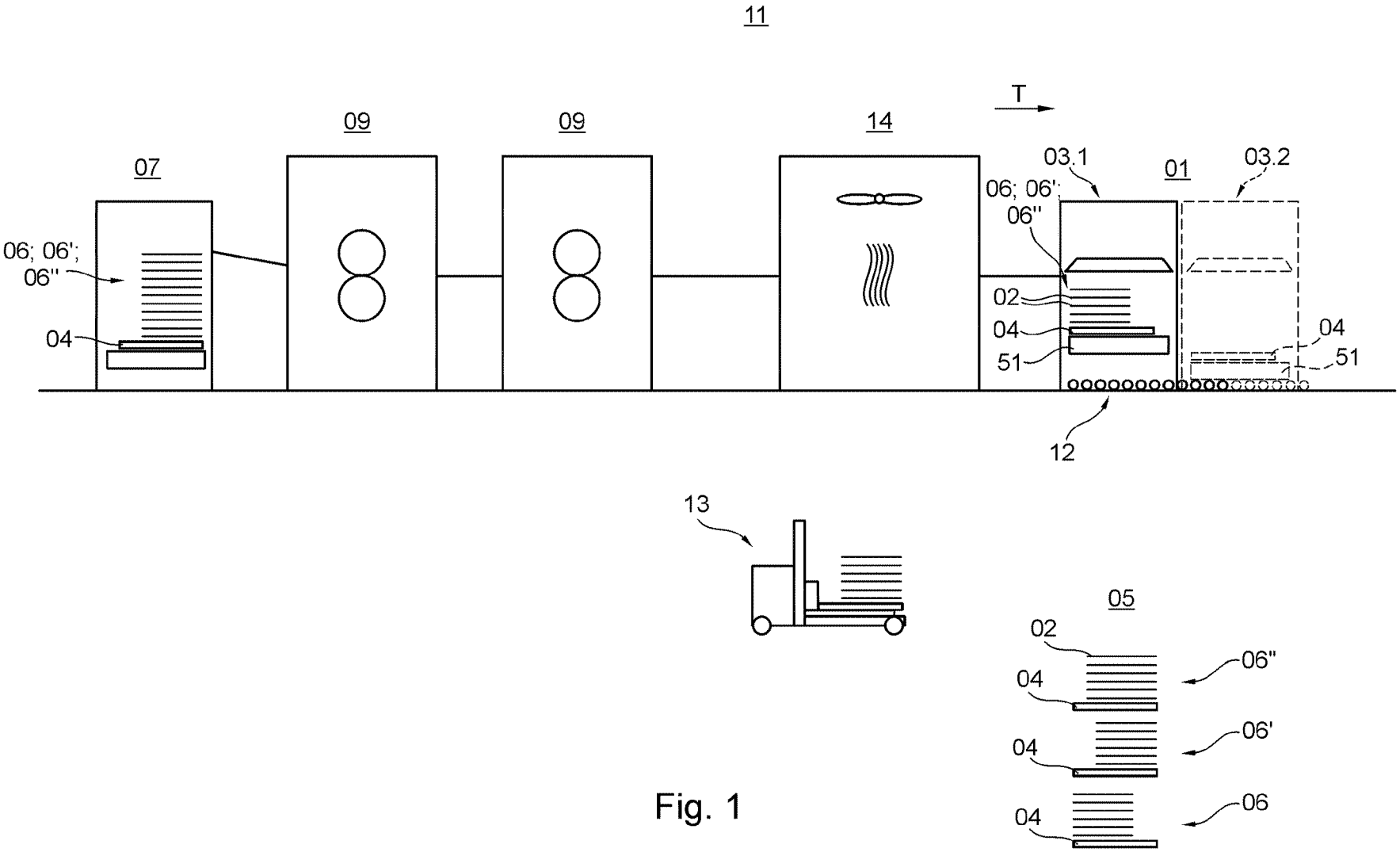
FIG. 1 shows a schematic side view of a machine for treating and/or processing sheets of material, having an output-side stacking device.

A device for stacking flat material sheets 02, or stacking device 01, comprises at least one pile delivery 03.1; 03.2, in some cases also called simply a delivery 03.1; 03.2, which has a stacking space, in which material sheets 02, in particular of the same format, entering on the intake side of stacking device 01, are to be stacked one on top of the other, i.e., with their lateral edges lying flush with one another, on a loading aid 04 to form a pile 06.

Preferably, stacking device 01 is part of a machine 11 for processing and/or treating material sheets 02, e.g. printing and/or coating machine 11, and is provided at the downstream end thereof in terms of the flow of material (see, e.g., FIG. 1). On the intake side, the printing and/or coating machine 11 comprises, for example, a material infeed system 07, e.g., called a feeder 07 or more particularly a pile feeder 07, which picks up the flat material sheets 02 from an intake-side pile 06; 06'; 06" and conveys them, via conveyor systems not described in further detail here, through a treatment and/or processing assembly 09 comprising one or more printing or coating units 09, and if applicable, subsequently through a dryer 14, for example a hot air dryer 14, and finally into stacking device 01 on the intake side thereof.

Here, the material sheets 02 are preferably in the form of metal sheets 02. Said sheets are preferably understood as thin sheets, i.e., no more than 1 mm thick, for example, and in particular rectangular, of a sheet metal, e.g., sheet steel or in particular sheet aluminum, which are wider and longer, e.g. each by more than a factor of 200, than they are thick. Pile delivery 03.1; 03.2 is preferably configured for stacking material sheets 02 of different material sheet formats, or formats for short, i.e., for stacking material sheets 02 of a first material sheet format having a first length and/or width in a first operating situation or production run, and for stacking material sheets 02 of a second material sheet format, the length and/or width of which is different from those of the first format, in a second operating situation or production run.

In principle, loading aid 04 may be embodied as a transportable support of any configuration that is suitable for holding a pile 06 of flat material sheets 02 on its upper surface and for being moved with said pile for transport purposes, e.g., by means of or via appropriate transport means 12; 13. In a preferred embodiment, loading aid 04 is configured as or in the manner of a pallet 04, which comprises a superstructure 16 for receiving the pile 06, having a planar loading base for supporting the pile 06; 06'; 06" to be received, said loading base having a single-part or multi-part, solid or interrupted support surface on its top side and a single-part or multi-part substructure 15, which supports the superstructure 16 from beneath and which has a plurality of supporting elements 17, e.g., bottom runners 17, in the form of blocks and so-called bottom boards, for example, extending lengthwise and/or transversely and spaced apart from one another, and optionally has additional cross members.

In a preferred embodiment, loading aid 04, which is or will be located on the intake side and/or on the output side of machine 11, is embodied as a standard loading aid 04, in particular as a standard pallet or uniform pallet 04, which has the same format for various material sheet formats to be supported. In contrast to conventional handling processes, in which suitable pallets 04 of different pallet formats are used for different material sheet formats, using the same pallet format for different material sheet formats allows a simplification of the automation or at least partial automation of a multi-stage process involving, for example, multiple treatment and/or processing machines to be traversed in succession, or at least allows the preconditions for automation or at least partial automation to be improved.

Standard loading aids 04 of this type may be used throughout the system, e.g., on the intake side of one or more machines 11, during transport, if necessary by a very wide range of different transport means 12; 13, or in a storage area 05, e.g., for the temporary storage of piles 06; 06'; 06" of material sheets 02 that are to be treated multiple times. Between machines 11 and/or between a machine 11 and a storage area 05, for example, at least one industrial truck 13, e.g., trackless, track-bound, or rail-guided, in particular an AGV 13 (automated guided vehicle), may be provided as transport means 13.

On the intake side, for example, a pile 06; 06'; 06" of material sheets 02 to be treated can be fed to machine 11 on a loading aid 04 that is larger in format than the material sheet format, i.e. on a loading aid 04, and/or on the output side, a pile 06 of treated material sheets 02 can be stacked on a loading aid 04 that is larger in format than the material sheet format, in particular a standard loading aid 04 of the same loading aid format.

Figure 2:
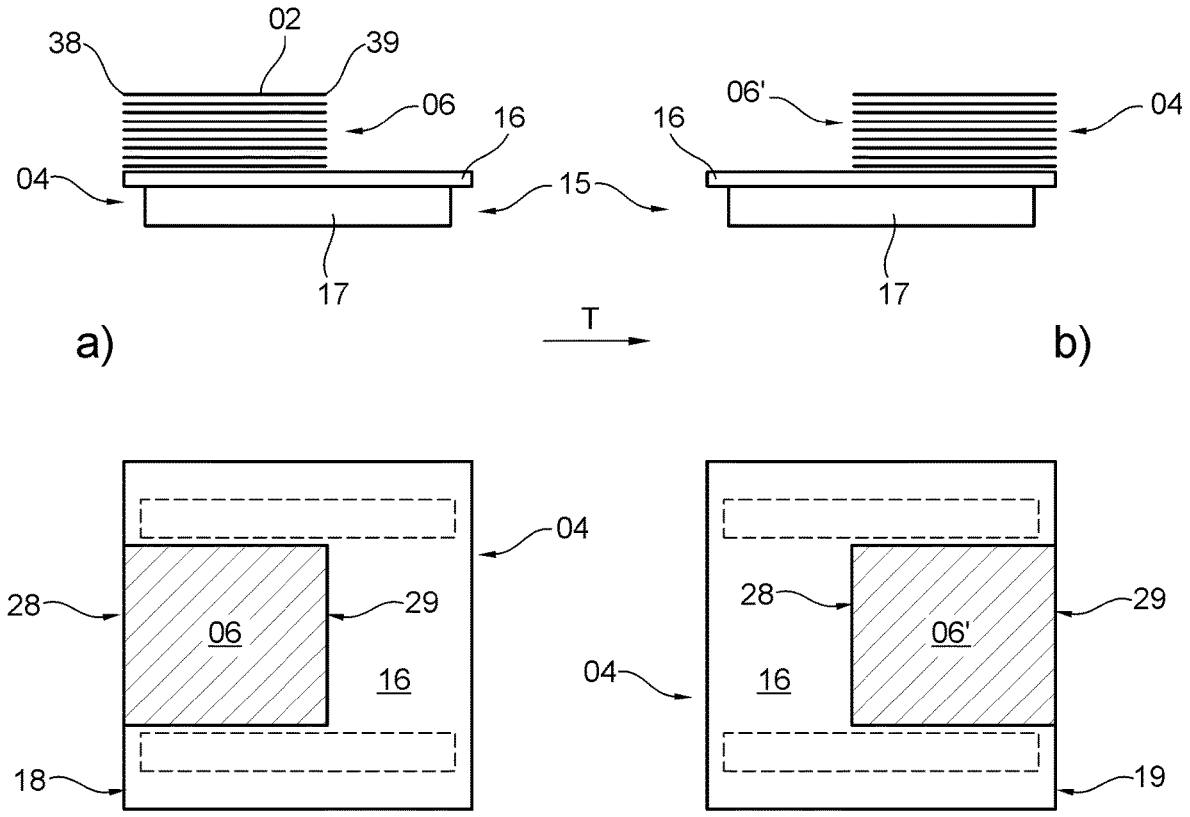
FIG. 2 shows a schematic side view and plan view illustrating the positioning of a pile a) along the front loading aid edge and b) along the rear loading aid edge.
Figure 3:
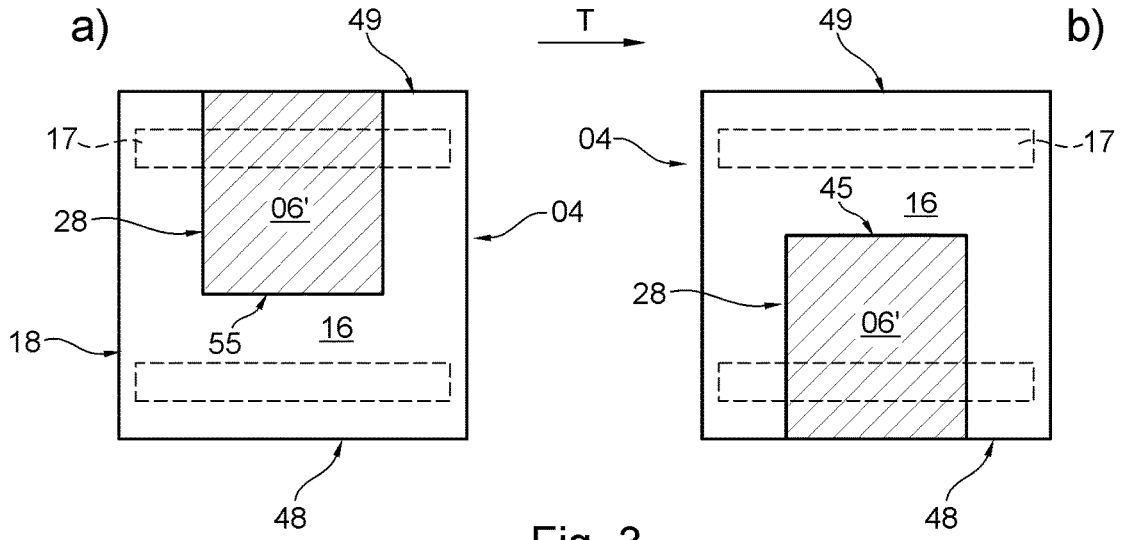
FIG. 3 shows a schematic plan view illustrating the positioning of a pile a) along the left loading aid edge, as viewed in the direction of transport, and b) along the right loading aid edge, as viewed in the direction of transport.

In production runs involving material sheets 02 that are smaller in format than the loading aids 04, it is particularly advantageous for the position of the pile 06 to be formed on the loading aid 04 located within the stacking space of stacking device 01 to be variable or definable, at least within certain limits. Piles 06; 06' of the same material sheet format can then merely be positioned differently on the loading aid 04 (for purposes of illustration, see as denoted by 06 and 06' in FIG. 1, FIG. 2, and FIG. 3, for example). In place of or in addition to this, however, the piles 06; 06" of two production runs may also have different material sheet formats from one another, for example, each being smaller than the loading aid format (for purposes of illustration, see as denoted by 06 and 06' and by 06" in FIG. 1, for example).

In the treatment or processing of material sheets 02, for two different production runs the respective piles 06; 06'; 06" are thus formed on loading aid 04 with the four corners of the main surface area of said piles in mutually different positions relative to said respective loading aid, which is located within the stacking space and is larger in format than the material sheets 02 to be deposited in each case. In other words, for two production runs, the piles 06; 06'; 06" are formed at mutually different locations on the loading aid 04 positioned within the stacking space.

In addition, in one advantageous embodiment, each of the piles 06; 06'; 06" to be formed is flush with the edge of at least one side of loading aid 04. This flush arrangement is understood as a precise alignment of pile side and loading aid edge 18; 19; 48; 49 (see below), with the exception of a slight protrusion of up to 20 mm, for example, preferably no more than 10 mm, of pile 06; 06'; 06" beyond the relevant loading aid edge 18; 19. For the sake of clarity, in the following this may also be subsumed under the term of a "substantially" flush arrangement.

To better meet the requirements of various subsequent working, storage, or transfer steps, for example, for two different production runs or operating modes the piles 06; 06'; 06" are formed flush along edges located on different sides of the loading aid 04, which is larger in format than the material sheets 02 to be deposited in each case. For instance, e.g., in one production run or operating mode, pile 06 may lie or be formed along the upstream loading aid edge 18, hereinafter also referred to as front edge 18 in reference to its orientation within the stacking space (see, e.g., FIG. 2*a*)), and in another production run or operating mode, pile 06' may lie or be formed along the downstream loading aid edge 19, hereinafter also referred to as rear edge 19 (see, e.g., FIG. 2*b*)). In place of or preferably in addition to this, piles 06; 06'; 06" for different production runs may also be formed along the two different lateral loading aid edges 48; 49, e.g., one on the left lateral edge 48 (see, e.g., FIG. 3*a*)) and another on the right lateral edge 49 (see, e.g., FIG. 3*b*)), as viewed from the transport direction T. Likewise, a pile 06; 06'; 06" that is smaller in format than loading aid 04 may be positioned or formed in one of the corners of loading aid 04, and in another production run or operating mode, such a pile may lie or be formed in a position different therefrom.

The terms "upstream" and "downstream", as far as stacking device 01 and the loading aid 04 or pile 06; 06'; 06" positioned there are concerned, relate, in particular, to the direction in which the flow of material is moving on the intake side of the stacking space for material sheets 02 to be deposited there.

Rather than varying the position of pile 06; 06'; 06" on loading aid 04 by correspondingly varying the location where sheets are released, in the framework of the solution presented here, which is advantageous especially in terms of complexity, the location of loading aid 04 is positioned in a defined manner at different points within the stacking space.

In a preferred embodiment, the point of deposition, in terms of the location within pile delivery 03.1; 03.2, for the material sheet front edges 38 that form a pile front side 28, e.g., upstream-facing pile side 28, remains stationary, as viewed in the transport direction T, for deposition onto piles 06; 06'; 06" that are in varying positions on loading aid 04 in the transport direction T. In other words, for production runs that involve positions of piles 06; 06'; 06" on loading aid 04 that differ from one another in the transport direction T, rather than varying the point of deposition, with respect to the pile delivery 03.1; 03.2, for the material sheet front edges 38 that form the pile front side 28, the position of loading aid 04 within the stacking space of pile delivery 03.1; 03.2 is varied. At the same time, loading aid 04 is positioned on a support means 51, which is movable vertically within the stacking space.

The point of deposition, with respect to pile delivery 03.1; 03.2, for the material sheet rear edges 39 that form a pile rear side 29 optionally varies with material sheets 02 that have varying format lengths in the transport direction T, to be deposited for different production runs. Conversely, in a variant of this, the location of the material sheet rear edges 38 that form the pile rear side 29, as viewed in the transport direction T, may remain stationary for deposition onto piles 06; 06'; 06" in positions on loading aid 04 that vary in the transport direction T, while in all other aspects, the teaching applies to this variant, modified appropriately as necessitated by the reversal.

It is particularly advantageous if, for the production runs that differ as mentioned above in terms of the deposition point onto pile 06; 06'; 06" on loading aid 04, a loading aid 04 of the same format, in particular an aforementioned standard loading aid 04, is positioned at different defined locations within the stacking space.

The positioning of loading aid 04 for at least one of two production runs or operating modes that have mutually different pile positions is preferably assisted by a data processing-based positioning aid, which determines and implements a position specification relating to the target position of loading aid 04, for example a position specification for a drive system for positioning the loading aid 04, or preferably a position specification for an alignment aid, e.g., using information I(L) relating to the required position of the pile 06; 06'; 06" on loading aid 04 and information I(F) relating to the format of material sheet 02 to be deposited. Said determination may also be made using information I(P) relating to position data that are stored for specific production situations. For this purpose, to determine the position specification, information I(P) relating to the position data for the preceding production run is retrieved, for example. The data processing-based positioning aid may comprise a data processing program, run in a data processing means, which is in signal communication with an intake-side interface via which one or more of the aforementioned types of information I(L); I(F); I(P) are or will be forwarded, and on the output side is in signal communication with a drive system for positioning a transport means 12 or an alignment aid 21; 22; 23; 24; 25; 26; 27.

The information I(L) relating to the required position of pile 06; 06'; 06" on loading aid 04 is transferred to the positioning aid, preferably by selection or indication on a control interface 59, for example, a control device 59, such as a touch panel 59, which is associated with pile delivery 03.1; 03.2 or even with the machine 11 as a whole, in particular by selecting a pile position or the loading aid edge 18; 19; 48; 49 designated for the flush arrangement, in a graphic depiction of a loading aid 04, or by selecting one of multiple graphically depicted loading aids 04 with differently positioned piles 06; 06'; 06".

In the case of an at least partially automated drive system, for example, for positioning the transport means 12 for loading aid 04, said drive system may be in the form of a drive means for the transport means 12, which receives and moves loading aid 04, at least within the stacking space, e.g., a drive motor for driving the roller conveyor 12. The drive means thereof, or a position controller that acts on said drive means, receives the position specification determined as described above, which brings about the target position of loading aid 04. To enable variable positioning transversely to the transport direction T, in place of or in addition to variable positioning along the transport direction T, a part of transport means 12, which is configured, e.g., as a driven roller conveyor 12, that is located within the stacking space may be arranged in or on a transversely movable and transversely actuable frame.

In an embodiment that is less complex in terms of the configuration of transport means 12, a target position of at least one alignment aid 21; 22; 23; 24; 25; 26; 27 is determined as the position specification relating to the target position of loading aid 04, and is implemented, i.e. positioning is carried out in accordance with the position specification. As alignment aids 21; 22; 23; 24; 25; 26; 27, one or more mechanical stop means, or preferably alignment aids 21; 22; 23; 24; 25; 26; 27 configured as optical indicators 21; 22; 23; 24; 25; 26; 27, may be provided, for which the relevant position specification is determined and the specification is implemented via appropriate actuation and/or drive means 41; 42; 43; 44, i.e., activation and/or positioning are carried out in accordance with the position specification. In principle, optical indicator 21; 22; 23; 24; 25; 26; 27 may be in the form of an indicator light, for example a one-dimensional or two-dimensional array of light-emitting diodes, which is provided in the support plane of the loading aid 04 to be positioned and which is actuated to indicate the target position for loading aid 04, for example, to optically highlight the target position of a reference line or a set of reference points, for example of a loading aid edge 18; 19; 48, 49 or loading aid corner.

In an advantageous embodiment illustrated here, at least one optical alignment aid 21; 22; 23; 24; 25; 26; 27 is in the form of a light projection 21; 22; 23; 24; 25; 26; 27 of a focused, for example punctiform or linear light beam, which is emitted by a light source 31; 32; 33; 34; 35; 36; 37, preferably a laser 31; 32; 33; 34; 35; 36; 37, in particular a line laser 31; 32; 33; 34; 35; 36; 37, and is to be visible in the support plane of the loading aid 04 to be positioned. At least one or more of the light projections 21; 22; 23; 24; 25; 26; 27 can be displaced in the horizontal direction for the purpose of bringing about various target positions, in that the associated light source 31; 32; 33; 34; 35; 36; 37 is movable by motor, as an entire unit or at least with respect to its beam direction, and is arranged in stacking device 01 or pile delivery 03.1; 03.2 such that it can be actuated in accordance with the determined target position.

For positioning loading aid 04, in particular for at least one of two production runs that have mutually different pile positions on loading aid 04 in the transport direction T, loading aid 04 in this embodiment is thus aligned along the horizontally movable light projection 21; 22; 23; 26 of a punctiform or linear light beam of a light source 31; 32; 33; 36, which is movable as an entire unit or at least with respect to its beam direction. A target position for light source 31; 32; 33; 36 or for the beam direction thereof is determined as a position specification and is implemented by appropriate drive means 41; 42; 43; 44.

To form the alignment aid 21; 22; 23; 24; 25; 26; 27 embodied as light projection 21; 22; 23; 24; 25; 26; 27, the image of a punctiform or linear light beam is projected by means of the relevant light source 31; 32; 33; 34; 35; 36; 37 or the beam direction thereof, at the level of the support plane of the loading aid 04 to be positioned, in particular on a support means 51 for receiving loading aid 04. Support means 51, e.g., also referred to as pile carrier 51, is movable vertically by means of a drive means (not shown), enabling the loading aid 04 disposed thereon to be moved between a lower position, in which it is positioned, for example, according to the target position, and an upper position, in which the stacking of material sheets 02 to form a new pile 06; 06'; 06" begins, for example. The length of pile carrier 51, as viewed in the transport direction T, in particular the part of said pile carrier that can be equipped with a loading aid 04, is greater than the length of the largest material sheet format to be stacked, and/or the support plane of said pile carrier for receiving loading aid 04 protrudes on the downstream side, as viewed in the transport direction T, beyond the rear side 29, farthest downstream, of the pile to be formed in or by means of pile delivery 03.1; 03.2, and/or in particular protrudes on the upstream side beyond the front side 28, farthest upstream, of the pile to be formed. Preferably, said pile carrier projects downstream beyond the stop by at least 50 mm or in particular by at least 100 mm and/or by at least one-tenth the length of the fixed or maximum distance to be set between the upstream and the downstream stop means 61; 52 under operating conditions for deposition. Pile carrier 51 is formed as a type of support frame, for example, which can dip into transport means 12, which is preferably configured as a roller conveyor 12.

In principle, one or more of the alignment aids 21; 22; 23; 24; 25; 26; 27, in particular light projections 21; 22; 23; 24; 25; 26; 27, which can be positioned in the manner described above in accordance with a determined target position and which are directed toward the alignment of different loading aid edges 18; 19; 48; 49, may be provided. In that case, an alignment aid 21; 22; 23; 24; 25; 26; 27 is assigned in a defined manner to a loading aid edge 18; 19; 48; 49 to be aligned, such that orienting the part of the loading aid 04 that is to be aligned along the alignment aid 21; 22; 23; 24; 25; 26; 27 (in particular with respect to the relevant direction) produces the desired position and/or the desired alignment of the corresponding loading aid edge 18; 19; 48; 49. In principle, the part of loading aid 04 to be aligned along alignment aid 21; 22; 23; 24; 25; 26; 27 may be fixed as any line or set of points on loading aid 04 that is suitable for bringing about a desired alignment and/or position of a loading aid edge 18; 19; 48; 49 of the loading aid 04 to be positioned in the support plane by placing said line or set of points along an alignment aid 21; 22; 23; 24; 25; 26; 27 corresponding thereto. Preferably, however, the lines or sets of points to be aligned are in the form of alignments that result naturally from the structure and geometry of loading aid 04 and are parallel to the loading aid edge 18; 19; 48; 49 to be aligned, such as are provided, for example, by loading aid edge 18; 19; 48; 49 to be aligned or by a loading aid edge parallel thereto, or by other edges, e.g., those of support elements 17 or of support elements 46 of a multi-part loading base that are separated from one another, e.g., by gaps 47. When a line or set of points other than the loading aid edge 18; 19; 48; 49 to be aligned is used, the position thereof relative to the position of the loading aid edge 18; 19; 48; 49 to be aligned is taken into account in determining the target position of the alignment aid 21; 22; 23; 24; 25; 26; 27 for the required target position of the loading aid 04.

Pile delivery 03.1; 03.2 is assigned at least one alignment aid 21; 22, for example optical alignment aid 21; 22, in particular light projection 21; 22, in particular at the level of the stacking plane, which is used for aligning and/or positioning the downstream loading aid edge 19 in terms of its location in the transport direction T, and the position of which alignment aid can be adjusted, over at least one adjustment range, by a drive means 41, in order to vary the target position for the loading aid 04 in the transport direction T. In principle, any line or set of points that is suitable in the above sense may serve as the part to be aligned along alignment aid 21; 22. Advantageously, however, the alignment aid 21; 22 that is used for aligning and/or positioning the rear edge 19, taking the length of the loading aid into account, for example, is intended for positioning the front edge 18, which in particular is parallel to the rear edge 19, or is preferably intended for positioning the rear edge 19 directly.

Figure 4:
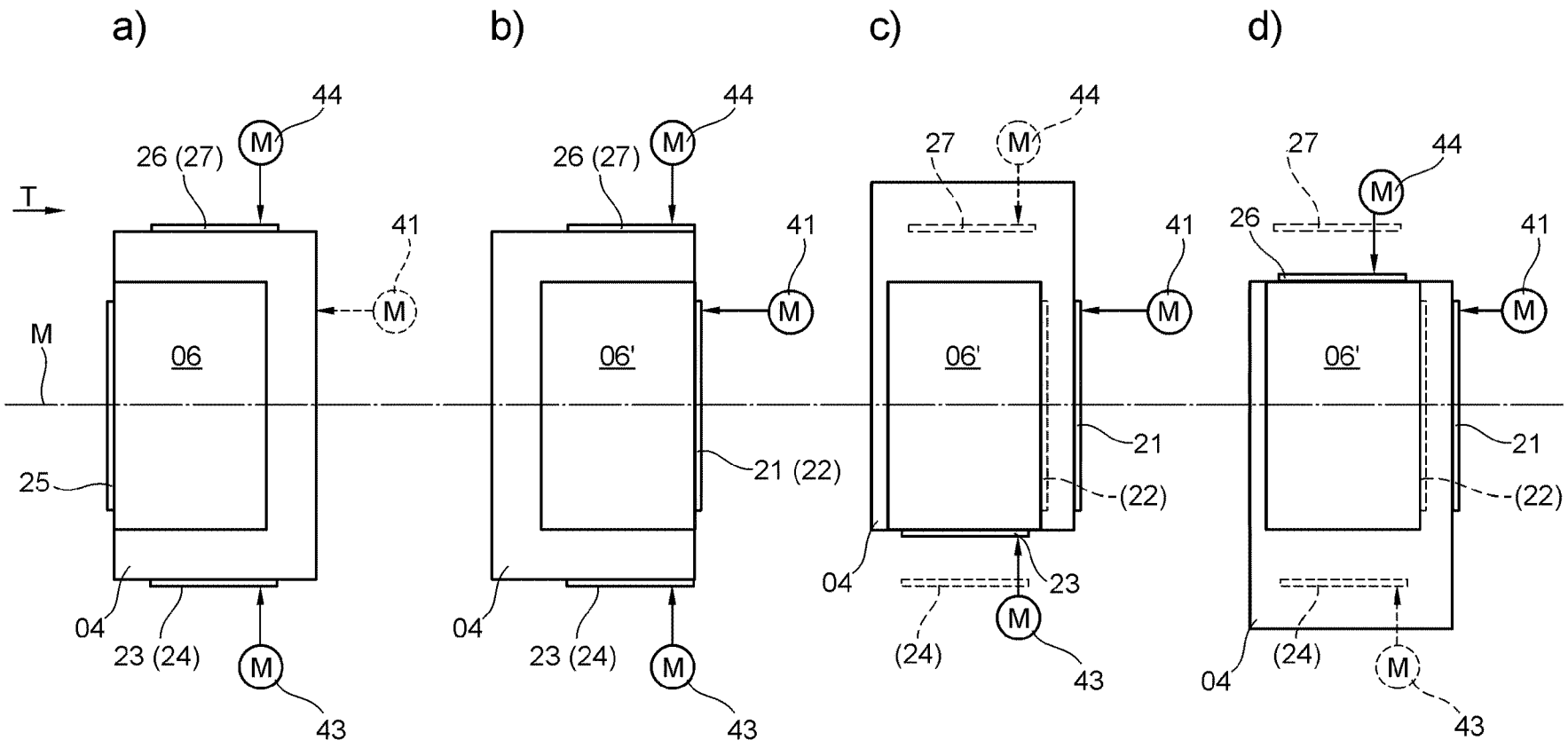
FIG. 4 shows a schematic plan view illustrating the positioning of the loading aid a) along an alignment means for the front loading aid edge and an alignment means for a lateral edge, for the centered positioning of the pile, flush with the front loading aid edge, b) along an alignment means for the rear loading aid edge and an alignment means for a lateral edge, for the centered positioning of the pile, flush with the rear loading aid edge, c) along an alignment means for the rear loading aid edge and an alignment means for one lateral edge, for positioning the pile flush with a lateral loading aid edge at a medium level along the length of the transport means and d) along an alignment means for the rear loading aid edge and an alignment means for the other lateral edge, for positioning the pile flush with the other lateral loading aid edge at a medium level along the length of the transport means.

For example, the at least one alignment aid 21, which is used for aligning and/or positioning the downstream loading aid edge 19 with respect to its location in the transport direction T, can be moved in the transport direction T, independently of a stop means 52, e.g. rear edge stop 52, of a stop device 53 that is used for aligning the material sheets 02 of the pile 06; 06'; 06" flush along the rear pile side 29, i.e. along the downstream-facing pile side 29, during pile formation. An alignment aid 21 that can be moved independently in the transport direction T in this manner, independently of rear edge stop 52, can be used to bring about different positioning on loading aid 04 in the transport direction T of a pile 06; 06'; 06" to be formed, e.g., including in an intermediate position in which said pile is spaced from both the front and the rear loading aid edges 18; 19 (see, e.g., FIG. 4*c*) and *d*)). On the other hand, in production runs that involve different format lengths and respective stacking along the rear loading aid edge 19, said mobility may be used for positioning the alignment aid 21 in accordance with the respective location of stop means 52.

In one embodiment variant, a first alignment aid 21, for example optical alignment aid 21, in particular light projection 21, which is used for aligning and/or positioning the downstream loading aid edge 19 with respect to its location in the transport direction T, can be moved in the transport direction T, independently of stop means 52 of stop device 53. Said alignment aid 21, which can be moved independently in the transport direction T, independently of rear edge stop 52, can be used in the above-described manner to bring about different positioning in the transport direction T of the pile 06; 06'; 06" to be formed on loading aid 04 (see, e.g., FIG. 4*c*) and *d*)). In addition, in this variant an additional alignment aid 22, for example, optical alignment aid 22, in particular light projection 22, is provided, in particular at the level of the stacking plane, which is used for aligning and/or positioning the downstream loading aid edge 19 with respect to its position in the transport direction T and which is or can be moved, together with stop means 52 of stop device 53, in the transport direction T. In production runs that involve different format lengths and respective stacking along the rear loading aid edge 19, said alignment aid 22 is positioned together with the rear stop means 52, by means of a drive means 42. For example, if pile 06; 06'; 06" is to be formed not along rear edge 19 of loading aid 04, but upstream thereof (see, e.g., FIG. 4*a*) or 4*d*)), said alignment aid will not be activated or at least will not be taken into account.

In a third variant, it is possible for only the alignment aid 22 that is positioned together with rear stop means 52 to be provided as the alignment aid 22 for aligning and/or positioning the downstream loading aid edge 19 with respect to its position in the transport direction T. However, this eliminates the possibility of positioning pile 06; 06'; 06" differently on loading aid 04 in the transport direction T.

In place of or more particularly in addition to the at least one or both alignment aids 21; 22 that is/are intended for positioning the rear loading aid edge 19, in one advantageous embodiment of stacking device 01 or pile delivery

03.1; 03.2, at least one alignment aid 23, for example optical alignment aid 23, in particular light projection 23, is provided, in particular at the level of the stacking plane; said alignment aid is used for aligning and/or positioning a first lateral loading aid edge 48 with respect to its position transversely to the transport direction T and can be moved transversely to the transport direction T, at least over an adjustment range, to vary the target position for the loading aid 04, and can be positioned by means of a drive means 43. In principle, any line or set of points that is suitable in the above sense can likewise serve as the part to be aligned along alignment aid 23. Advantageously, however, the alignment aid 23 that is used for aligning and/or positioning the first lateral edge 48 is aimed at positioning the second lateral edge 49, parallel, in particular, to the first lateral edge 48, or preferably, is aimed at positioning the first lateral edge 48 directly, taking a known loading aid width into account, for example.

In a first configuration, the lateral positioning of alignment aid 23 may be movable or positionable independently of a lateral stop means 54, e.g., lateral edge stop 54, of a stop device 56 for aligning the material sheets 02 of pile 06; 06'; 06" during pile formation, flush along a lateral pile side 55, i.e., facing transversely to the transport direction T. In a preferred configuration illustrated here, lateral alignment aid 23 can be positioned jointly with lateral stop means 54 by means of drive means 43. In production runs that have different format widths and respective stacking along the lateral loading aid edge 48, alignment aid 23 is then positioned jointly with lateral stop means 54 by means of drive means 43.

For example, the at least one alignment aid 23, which is used for aligning and/or positioning a first lateral loading aid edge 48 with respect to its position transversely to the transport direction T, is restricted in terms of its positioning distance toward the outside, mechanically and/or in terms of control, to a lateral position which is in alignment with the lateral material sheet edge of a material sheet 02 of the largest possible format width to be guided and deposited, or to the widest possible material sheet 02 to be guided and deposited on said machine side in pile delivery 03.1; 03.2. In this outer position, alignment aid 23 defines the lateral position of loading aid 04 for cases in which material sheets 02 of the greatest possible format width or having the widest possible laterally guided position are or will be deposited.

In addition to or in place of the aforementioned lateral restriction of the positioning distance, in one variant of the aforementioned embodiment, an alignment aid 24 may be expressly provided, which, in particular at the level of the stacking plane, is in alignment with the lateral material sheet edge of a material sheet 02 of the largest possible format width to be guided and deposited, or of a widest possible material sheet 02 to be guided and deposited on said machine side in pile delivery 03.1; 03.2. This alignment aid 24 (see, e.g., as indicated by dashed lines in FIGS. 4*c*) and 4*d*)) may be embodied as a fixed mark 24, as a lateral stop 24, or as provided here as an optical display means 24, in particular as a light projection 24 from an aforementioned light source 34, and may be operatively stationary, for example, but may also be adjustable, in relation to pile delivery 03.1; 03.2. For example, if loading aid 04 will be positioned not at the outermost point, but at a point that lies further inward (see, e.g., FIG. 4*c*)), said alignment aid will not be activated, or at least will not be taken into account.

In a third variant, it is also possible for only the stationary alignment aid 24 to be provided, in which case for every format width, for example, the pile 06; 06'; 06" to be stacked is formed on loading aid 04 symmetrically to the center that divides the loading aid in half widthwise.

In an advantageous refinement of the embodiment having at least the one alignment aid or both alignment aids 23; 24, which are aimed at positioning the first lateral loading aid edge 48, in an advantageous refinement of stacking device 01 or of pile delivery 03.1; 03.2, in particular at the level of the stacking plane, at least one alignment aid 26, for example optical alignment aid 26, in particular light projection 26, is provided, which is used for aligning and/or positioning the other or second lateral loading aid edge 49 in terms of its position transversely to the transport direction T, and which can be moved, at least over a positioning range, and positioned by means of a drive means 44 for the purpose of varying the target position for loading aid 04 transversely to the transport direction T. For the embodiment of this alignment aid 26 and where applicable for the embodiment of a further lateral alignment aid 27 (indicated by dashed lines, FIG. 4*c*) and *d*)), which limits the maximum outer position and is provided additionally to or in place of the first, the above description referring to alignment aid 23; 24 for the first lateral loading aid edge 48 applies accordingly, with the exception that this alignment aid is arranged and acts in a mirror image to the machine center plane M that extends vertically and divides the maximum transport path width in stacking device 01 at the center. This applies to all three variations and drive configurations mentioned, and in one drive configuration, lateral alignment aid 26 can be positioned jointly, together with a lateral stop means 57, e.g., lateral edge stop 57, of a stop device 58 provided for the other pile side 55; 45, by means of a relevant drive means 44.

In addition to the at least one or to both alignment aids 21; 22, which are aimed at positioning the rear loading aid edge 19, and/or in addition to the alignment aid 23; 24; 26; 27, provided on one or on both sides and aimed at positioning the lateral loading aid edge 49; 48, in an advantageous refinement of stacking device 01 or pile delivery 03.1; 03.2, in particular at the level of the stacking plane, at least one alignment aid 25 is provided, which is used for the alignment and/or positioning of the front loading aid edge 18 in terms of the location thereof in the transport direction T. Once again, in principle, any line or set of points that is suitable in the above sense may serve as the part of loading aid 04 that is to be aligned along alignment aid 25. Advantageously, however, the alignment aid 25 that is used for aligning and/or positioning the front edge 18 is aimed at positioning the rear edge 19, parallel, in particular, to the front edge 18, or preferably is aimed at positioning front edge 18 directly, for example, taking a known loading aid length into account. Said alignment aid 25 (indicated, e.g., in FIG. 4*a*)) may be embodied as a fixed mark 25, as a stop 25, or as provided here as an optical indicator 25, in particular as a light projection 25 from an aforementioned light source 35, and under operating conditions may be stationary, for example, but may also be adjustable, in relation to pile delivery 03.1; 03.2. For example, if pile 06; 06'; 06" is to be formed not directly along front edge 18 but at a point further toward the rear on loading aid 04 (see, e.g., FIG. 4*b*), *c*), or *d*)), said alignment aid will not be activated, or at least will not be taken into account.

The above description relating to the positioning of the rear edge 19, the two lateral edges 48; 49, and the front edge 18 applies accordingly to the reverse case, in which for piles 06; 06'; 06" of different format lengths and/or varying positions in the transport direction T to be formed on loading aid 04 with pile delivery 03.1; 03.2, the pile rear side 29, rather than the pile front side 28, remains fixed in terms of its location in pile delivery 03.1; 03.2 in the transport direction T, but with the exception that the alignment aids 21; 22; 25 provided for the alignment of rear edge 19 and front edge 18 are arranged and act in mirror inversion to a vertical plane extending transversely to the transport direction T in the stacking space. In that case, for example, the rear alignment aid 21; 22 is stationary in accordance with the above-described front alignment aid 25, and a front alignment aid 25 is positionable in the transport direction T in accordance with the described rear alignment aid 21; 22, and if necessary, may be embodied as "double" in the manner described above. In that respect, although the fixed location of pile front side 28 in the transport direction T in pile delivery 03.1; 03.2 is preferred, the teaching applies, in principle, to both cases, i.e., to a fixed location of the pile front side 28 and to a fixed location of the pile rear side 29.

Independently, in principle, of the described assistance in the positioning of loading aid 04 by means of a positioning aid, or independently of an embodiment thereof, described above, but especially advantageously in conjunction with such, the loading aid 04, which is as yet unloaded and/or is larger in format than the material sheets 02, is first positioned within the stacking space for a subsequent pile formation, and afterward is moved vertically upward, at least until it is in physical contact in the region of its upper surface with the lower edge of a stop means 52; 54; 57; 61, which aligns the material sheets 02 of the pile 06; 06'; 06" flush along at least one pile side 28; 29; 45; 55 during pile formation, or until the stop means 52; 54; 57; 61 is resting on the upper surface of loading aid 04, in particular on the loading base or on the superstructure 16 thereof. To further reduce the risk of a slight gap remaining, loading aid 04 is preferably moved vertically upward until it raises the stop means 52; 54; 57; 61 in question, or at least a lower part thereof, at least slightly, i.e., for example, by at least 3 mm, in particular at least 5 mm, relative to the position it occupied previously in the contact-free state. For this purpose, the relevant stop means 52; 54; 57; 61 or the part thereof to be raised is mounted so as to be movable vertically on frame 63 of stacking device 01.

Figure 5:
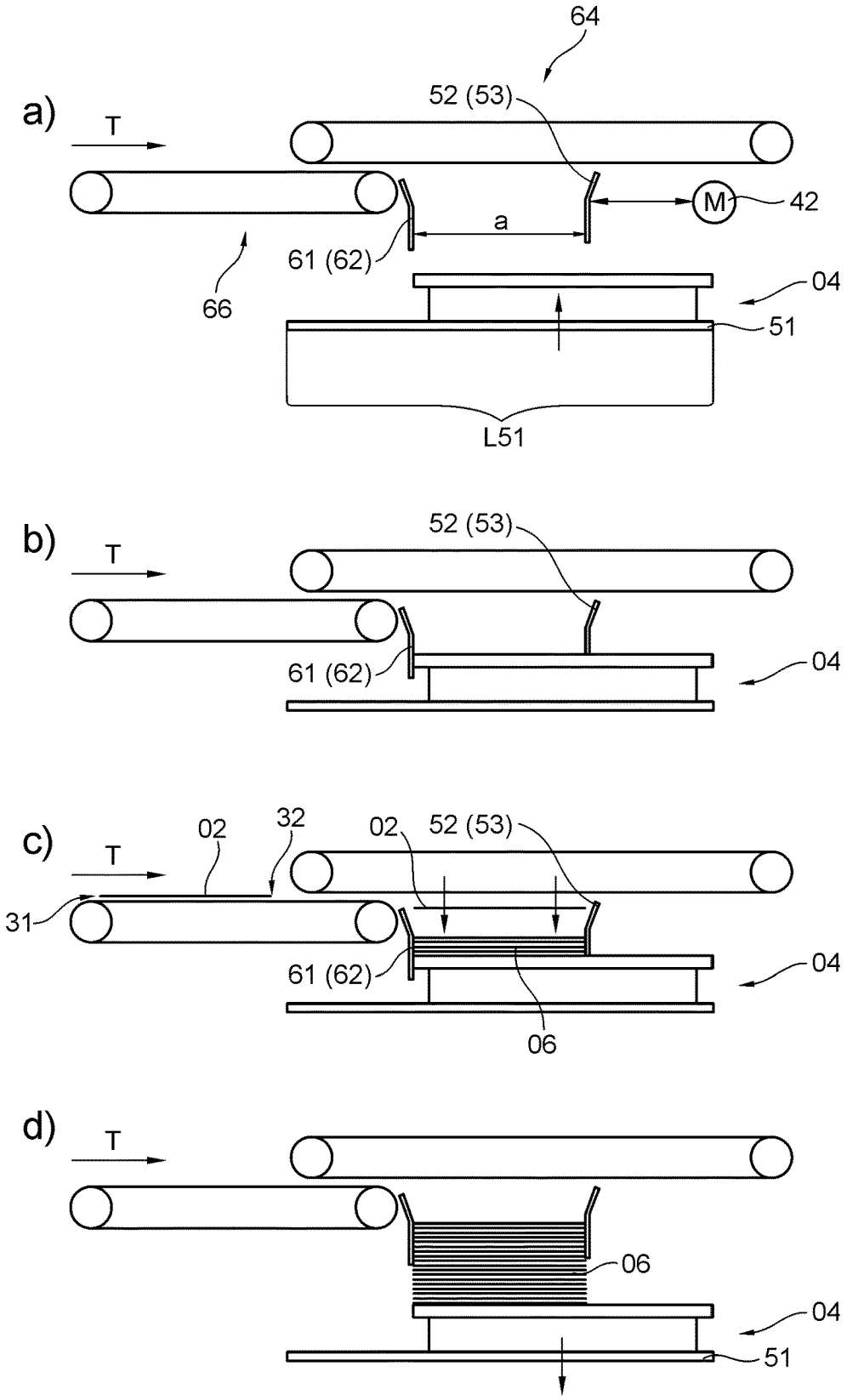
FIG. 5 shows a schematic illustration of a process during the stacking of material sheets flush with the front loading aid edge, in which a) the loading aid to be loaded, which previously was positioned aligned approximately with the front edge stop, is moved upward until b) it has reached the starting position required for stacking to begin, in order for c) the first material sheets to be deposited thereon, and d) the top edge of the pile is kept at a constant level for the deposition of additional material sheets by lowering the loading aid.

Thus, for instance, if a pile 06; 06'; 06" is to be formed along the front edge 18 of loading aid 04, loading aid 04 will be positioned within the stacking space, optionally without, but preferably with the assistance of a position specification for a drive or for an above-described alignment aid 21; 22; 23; 24; 25; 26; 27, such that the front edge 18 of loading aid 04 is flush vertically with a stop surface of a stop means 61, e.g., front edge stop 61, of a stop device 62 for aligning the material sheets 02 of pile 06; 06'; 06" flush along the pile front side 28 thereof during pile formation, or is offset at most slightly, i.e., by up to 20 mm or a maximum of 10 mm, along the transport direction T, in particular downstream (see, e.g., FIG. 5*a*)).

Once loading aid 04 has been positioned, preferably assisted in the manner described above, it is moved upward at least until a stop means 52; 54; 57; 61 on the pile side 28; 29; 45; 55 that is to be aligned substantially flush, in this case in particular front edge stop 61, and the upper surface of loading aid 04 overlap vertically at least slightly, and/or until the stop means 52; 54; 57; 61 on the opposite pile side 28; 29; 45; 55, here in particular the rear edge stop 52, rests on the upper surface of loading aid 04, in particular until the movable part of said loading aid is raised slightly, as described above, from the position it occupied in the unloaded state (see, e.g., FIG. 5*b*)). Pile 06; 06'; 06" is then formed at the intended location on loading aid 04 by material sheets 02, entering on the intake side, being stacked one on top of the other on the previously positioned loading aid 04. During stacking, the sheets are aligned flush by means of the front and rear edge stops 52; 61, and optionally by lateral edge stops 54; 57, which may be provided on one or both sides, to form a pile 06; 06; 06" (see, e.g., FIG. 5*c*)). As the pile height increases, but optionally only after it reaches a minimum height, loading aid 04 is moved downward so that the upper surface of the pile remains at the same level as sheet stacking continues (see, e.g., FIG. 5*d*)).

Figure 6:
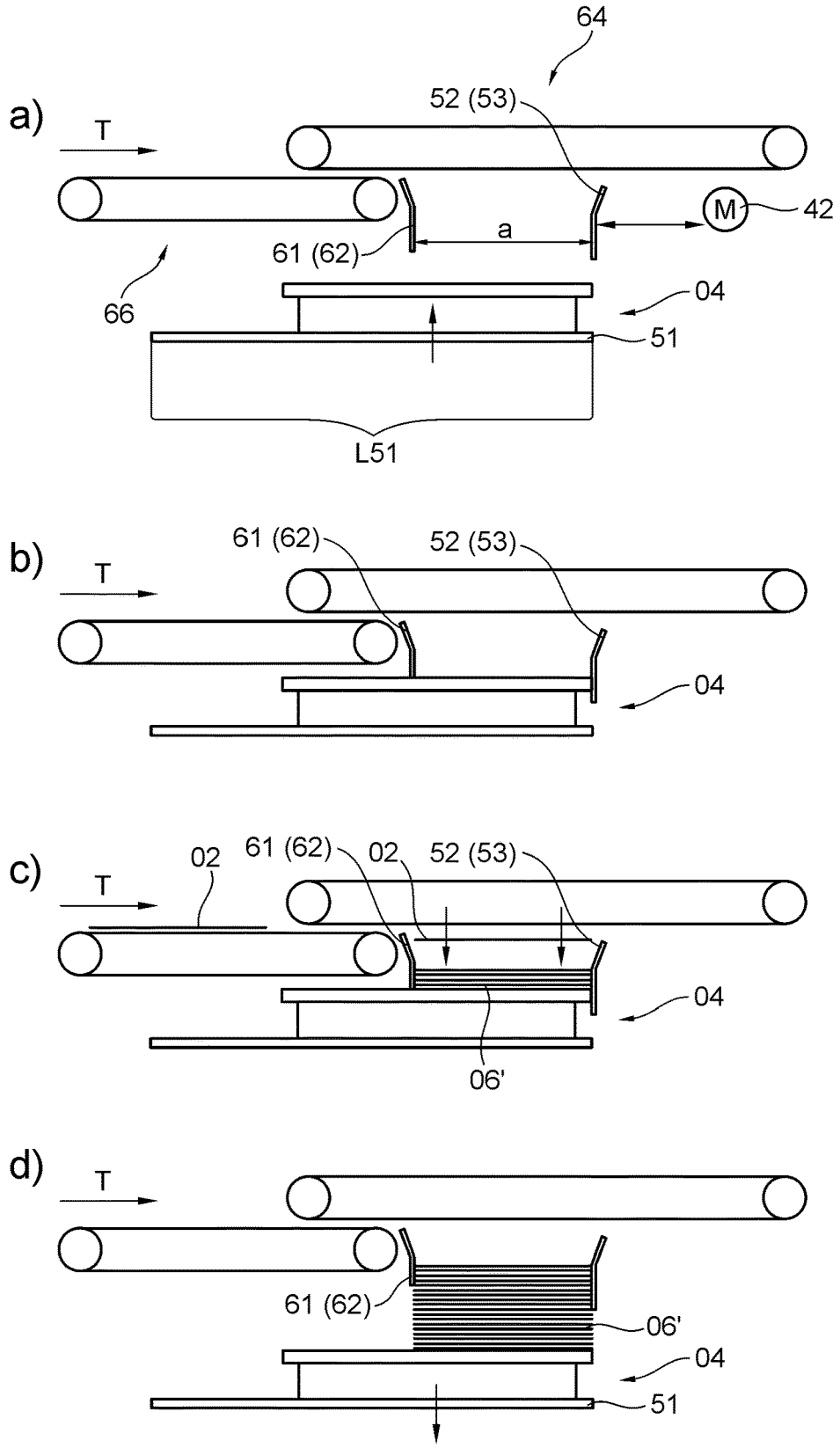
FIG. 6 shows a schematic illustration of a process during the stacking of material sheets flush with the front loading aid edge, in which a) the loading aid to be loaded, which previously was positioned aligned approximately with the rear edge stop, is moved upward until b) it has reached the starting position required for stacking to begin, in order for c) the first material sheets to be deposited thereon, and d) the top edge of the pile is kept at a constant level for the deposition of additional material sheets by lowering the loading aid.

In another operating situation, in which pile 06; 06'; 06" is to be formed, in the manner described above, flush along the opposite pile side 28; 29; 45; 55, here in particular the rear pile side 29, loading aid 04 is positioned within the stacking space optionally without, but preferably with the assistance of a position specification for a drive or an aforementioned alignment aid 21; 22; 23; 24; 25; 26; 27, such that the rear edge 19 of loading aid 04 is aligned vertically with a stop surface of a stop means 52, e.g., rear edge stop 52, of a stop device 53 for aligning the material sheets 02 of pile 06; 06'; 06" flush along the rear side 29 thereof during pile formation, or is offset therefrom at most slightly, i.e., by up to 20 mm or a maximum of 10 mm, along the transport direction T, in particular upstream (see, e.g., FIG. 6*a*)). The correspondingly positioned loading aid 04 (see, e.g., FIG. 6*a*)) is then moved upward at least until the stop means 52; 54; 57; 61 of said pile side 28; 29; 45; 55, in this case, in particular, the rear edge stop 52, and the upper surface of loading aid 04 overlap vertically at least slightly, and/or until the stop means 52; 54; 57; 61 on the opposite pile side 28; 29; 45; 55, here the front edge stop 62, rests on the upper surface of loading aid 04, in particular until the movable part of said loading aid is raised slightly, as described above, from the position it occupies in the unloaded state (see, e.g., FIG. 6*b*)). Pile 06; 06'; 06" is then formed at the intended location on loading aid 04 by material sheets 02, entering on the intake side and aligned as described above by means of stop means 52; 54; 57; 61 and, if applicable, the synchronous lowering, being stacked one on top of the other on the previously positioned loading aid 04 (see, e.g., FIG. 6*c*)).

To enable the variable positioning of a loading aid 04, which in particular is larger in format than the material sheet format, the vertically movable pile carrier 51 has, in particular, a significantly greater length L51, i.e., at least 50 mm or in particular 100 mm or even at least 200 mm greater, as viewed in the transport direction T, than a fixed or maximum distance a to be set between the upstream and the downstream stop means 61; 52 under operating conditions, i.e., for the operating mode of a production run, for the purpose of deposition. In place of or in addition to this, the vertically movable pile carrier 51 protrudes on at least the upstream side, as viewed in the transport direction T, in particular significantly, i.e., by, e.g., at least 50 mm or even at least 100 mm, beyond the vertical alignment of the stop surface, facing the stacking space, of the stop means 61, which aligns the material sheets 02 flush along the upstream pile side 28 during pile formation. In that case, under operating conditions the upstream stop means 61 is frame-fixed with respect to the transport direction T, but may also optionally be mounted adjustably, e.g., by several millimeters, for example, at most 50 mm, while the downstream stop means 52 is mounted such that under operating conditions it can be moved along the transport direction T, e.g., by more than 50 mm, in particularly even by more than 100 mm, to adjust for the stacking of different material format lengths.

Because the length of loading aid 04 is, e.g., at least 50 mm, in particular 100 mm or even 200 mm, greater than the normal operational or maximum distance a between upstream and downstream stop means 61; 52, during a stacking process in which the loading aid front edge (19) is aligned with the downstream stop means 52 or is offset at most slightly, i.e. by up to 20 mm, along the transport direction (T), the transport aid protrudes with its upstream loading aid front edge 18 by, e.g., at least 30 mm, in particular by at least 80 mm, or even by 180 mm, beyond the vertical alignment of the stop surface, facing the stacking space, of the stop means 61 that is aligning material sheets 02 flush along the upstream pile side 28 during pile formation.

Thus, as viewed in the transport direction T, the stacking space has an open cross-section that is configured such that stacking can be carried out on a loading aid 04, which is positioned on the vertically movable pile carrier 51 and which protrudes, e.g. by at least 30 mm, in particular by at least 80 mm or even by at least 180 mm beyond the vertical alignment of the stop surface, facing the stacking space, of the stop means 61 that is aligning material sheets 02 flush along the upstream pile side 28 during pile formation.

In general, material sheets 02 may be conveyed and deposited by any suitable type of conveying means, such as those provided by belt or gripper systems, for example. In the case that is preferred here, in particular the case of metal sheets, for at least one conveyor line section that conveys the material sheets 02 above the stacking space in stacking device 01, a conveyor system 64, in particular an overhead transport system 64, e.g., a belt conveyor system 64 that holds the material sheets 02 from above, is provided. In general, said conveyor device can be configured based upon known principles of action, for example, holding by magnetic force or by vacuum pressure, but in this case is preferably configured as vacuum-based. The overhead transport system 64 is embodied to decelerate the material sheets 02, which are picked up on the intake side, along the transport path up to the delivery. For this purpose, the overhead transport system 64 preferably is or is to be driven by a drive means, in particular a drive motor, in such a way that, synchronized with the intake of material sheets 02, it receives the respective material sheet 02 on the intake side at the transport speed being used there, and comes to a halt with said material sheet positioned precisely above the pile shaft formed by the stop means 52; 54; 57; 61, where it releases material sheet 02, after which it is accelerated again to the transport speed of the incoming material sheets 02 and picks up the next material sheet 02.

Upstream of the conveyor line section for conveying material sheets 02 above the stacking space in stacking device 01, a conveyor section having a transport system 66 may be provided, which transports and delivers the material sheets 02 to the subsequent conveyor system 64. Transport system 66 is embodied, for example, as a belt conveyor system 66 that supports the material sheets 02 from below.

Although the aforementioned solution that includes variably selectable pile positioning is advantageous, in principle, even for a stacking device 01 that comprises only one pile delivery 03.1; 03.2, its advantages are realized especially in a stacking device 01 that comprises multiple pile deliveries 03.1; 03.2 arranged in succession in the transport direction T, in which case for some or all of the pile deliveries 03.1; 03.2, such a variably selectable pile positioning is provided. With alternating pile formation, an interruption-free pile change is possible, or piles 06; 06'; 06" that differ from one another in terms of pile position may be formed for an additional, different destination, as may be necessary, for example, for the ejection and optionally the subsequent recycling of waste sheets in a separate pile 06; 06'; 06".

Figure 7:
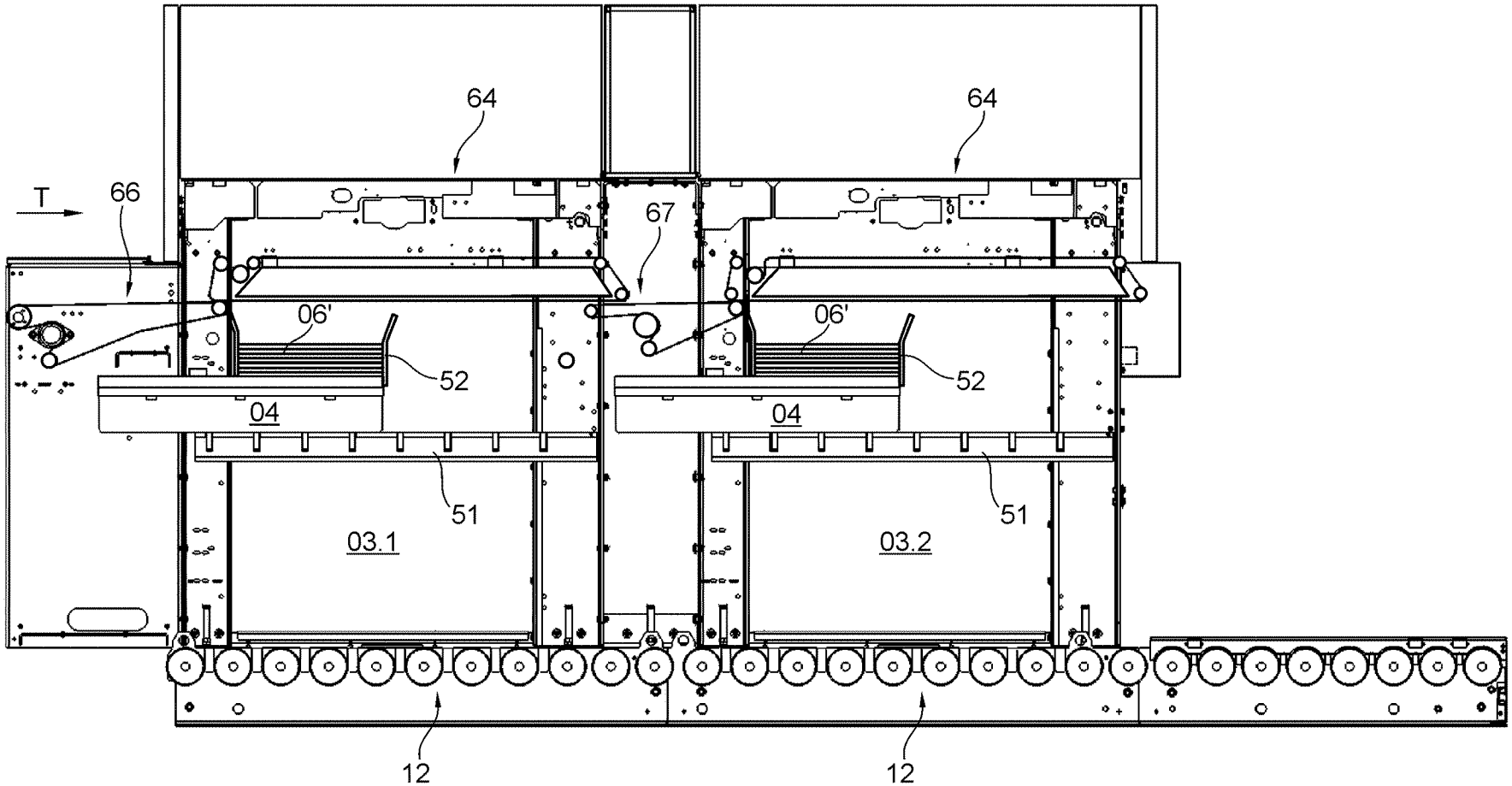
FIG. 7 shows a side view of a stacking device having two pile deliveries, one behind the other in the transport direction.

In a preferred embodiment, for instance, the stacking device 01 has a first and at least one second pile delivery 03.1; 03.2, for example in the transport direction T of the material sheets 02 to be stacked, each delivery having a stacking space into which a loading aid 04 can be introduced in the manner described above and can be positioned, optionally with the assistance of at least one alignment aid 21; 22; 23, 24; 25, 26, 27, in differently defined relative positions within the stacking space of the pile delivery 03.1; 03.2. The same components or components that have the same function are identified, e.g., in FIG. 7, by the same reference signs for the two pile deliveries 03.1; 03.2 illustrated therein.

Rather than providing a uniquely dedicated overhead transport system 64 for each pile delivery 03.1; 03.2, in an alternative not shown here it is also conceivable for a continuous overhead transport system 64, which has sections, the holding action of which can be switched on and off independently of the others, for example, to be provided as the conveyor line section that extends above the stacking spaces of both the first and the second and optionally of additional pile deliveries 03.1; 03.2.

If an overhead transport system 64 is provided for each pile delivery 03.1; 03.2, said transport systems can be connected directly to one another, and a material sheet 02 to be conveyed to the second pile delivery 03.1; 03.2 can be transferred directly between these overhead transport systems 64. However, in an embodiment illustrated here which is advantageous in terms of control, for the transfer of the material sheets 02 between the two pile deliveries 03.1; 03.2, a conveyor section having a transport system 67 is provided, via which the material sheets 02 are transferred between the overhead transport systems 64 of the first and second pile deliveries 03.1; 03.2. Said transport system 67 is embodied, for example, as a belt conveyor system 67 that supports the material sheets 02 from below.

The embodiment features for the variable positioning of loading aid 04 in the horizontal direction and/or the vertical positioning thereof in an advantageous embodiment will be further clarified in reference to FIGS. 8 to 12. Unless otherwise stated or explicitly otherwise formulated, the individual embodiment features or combinations thereof apply both to an embodiment having only one pile delivery 03.1 and to the advantageous embodiment having multiple pile deliveries 03.1; 03.2.

Figure 8:
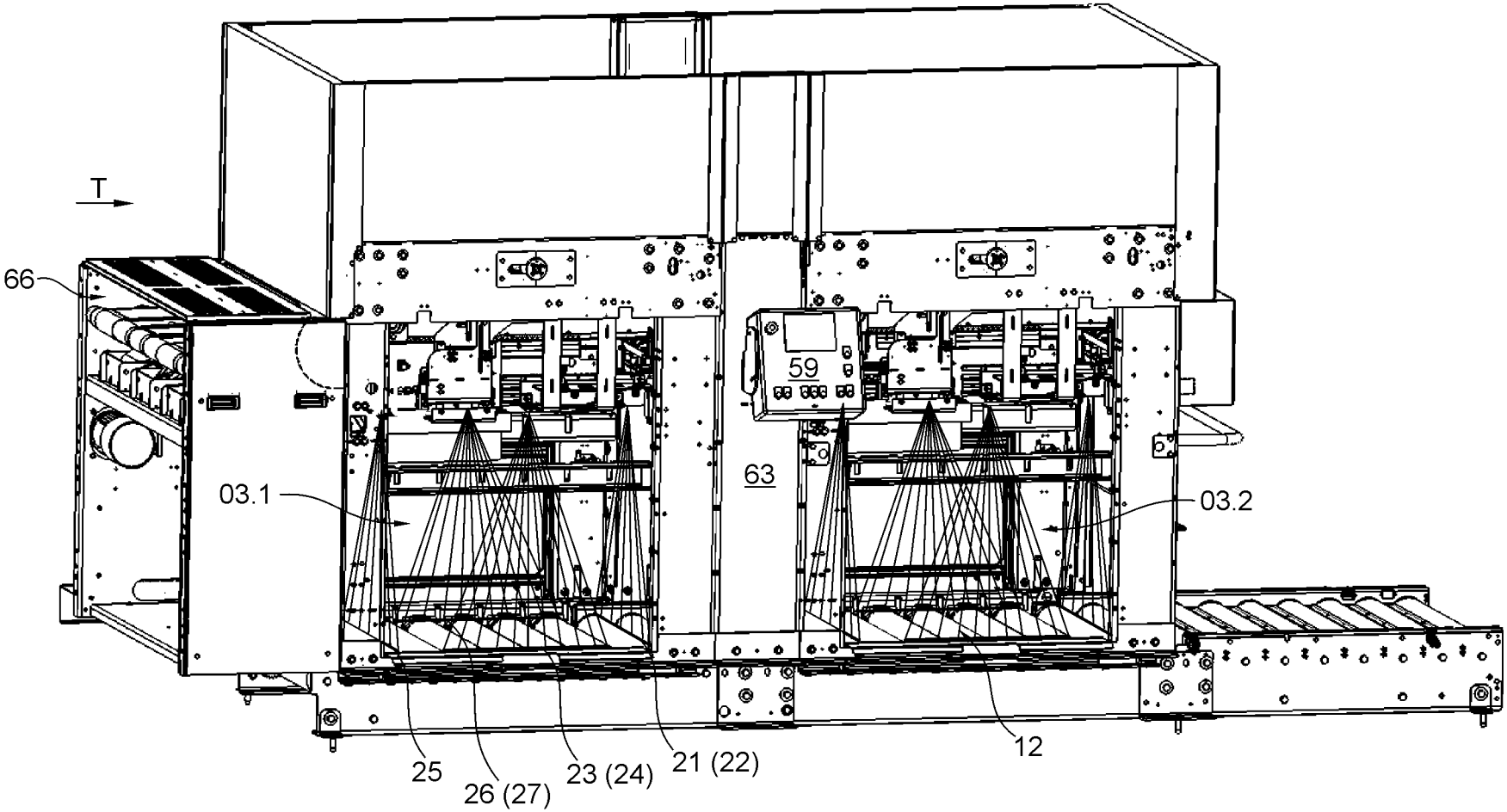
FIG. 8 shows an oblique view of a stacking device with schematically depicted alignment aids formed by light projections.
Figure 9:
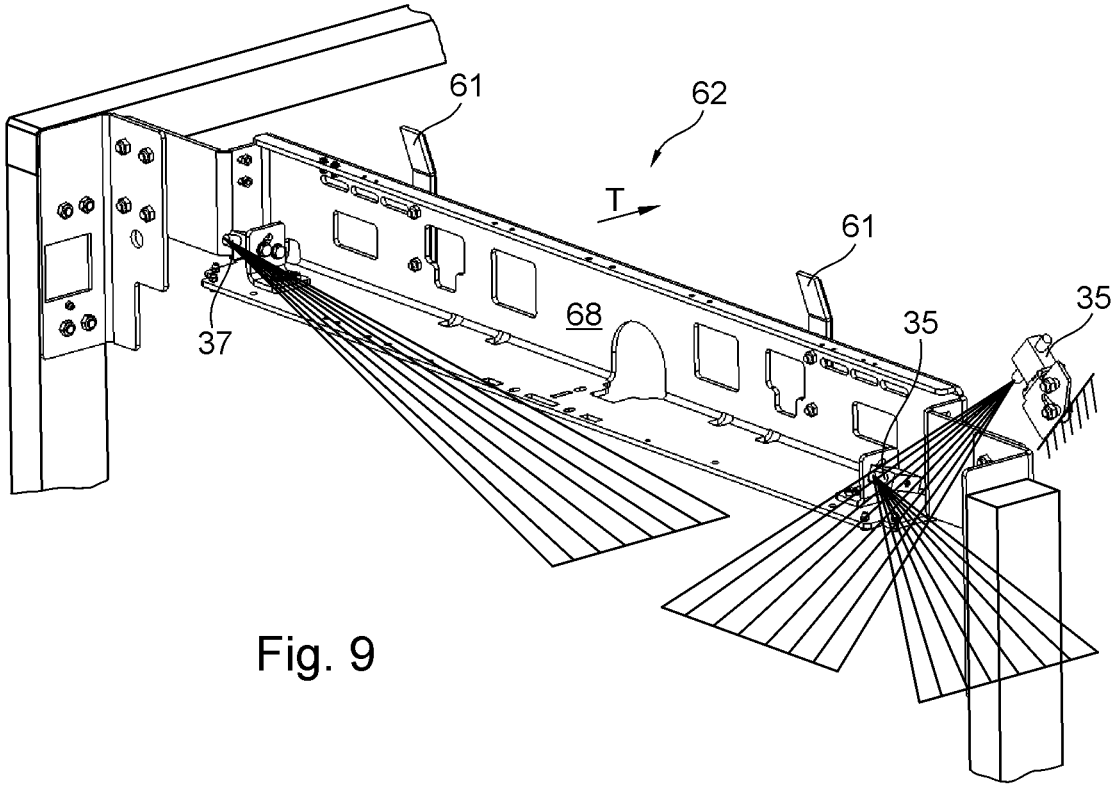
FIG. 9 shows a detailed representation of a front upper part of a pile delivery, with light sources and with the light beam path indicated for alignment aids formed by light projections.

FIG. 8 schematically illustrates the aforementioned light projections 21; 22; 23, 24; 25; 26; 27 cast into the stacking plane, along with the respective light beam of a light source 31; 32; 33; 34, 35; 36; 37 configured, for example, as a line laser. In contrast to the illustration, for example, stationary alignment aids 24; 27 and, if applicable, 25 may be in the form of marks 24; 27 and 25, respectively, or in the form of mechanical stops 24; 27 and 25, respectively.

Also shown are the intake-side transport system 66, the transport means 12 configured as a roller conveyor 12, and a control interface 59 located on the frame 63 of stacking device 01. In this case, the latter is embodied, for example, as a control panel 59, in particular as a touch panel 59.

In principle, the light sources 31; 32; 33; 34, 35; 36; 37 that produce the light projections 21; 22; 23, 24; 25; 26; 27 could also be located below the stacking plane, casting light onto, e.g., a translucent surface in or below the stacking plane. In the advantageous embodiment illustrated here, however, the light sources 31; 32; 33; 34, 35; 36; 37 are arranged above the stacking plane and cast light from above into the stacking plane, where it is reflected, for example, onto parts of pile carrier 51 and/or transport means 12.

One or more front edge stops 61 may be provided on a crossbar 68, which is part of the frame 63. Additionally, for the embodiment of the alignment aid 25 that serves to align the pile front edge 28 of loading aid 04 as an optical indicator 25, for example, the light source 35 that produces said alignment aid is provided on crossbar 68 (see, e.g., FIG. 9). The stop surfaces of the front edge stops 61, which face the pile 06; 06'; 06" to be formed, and the optical alignment aid 25 preferably lie in a common vertical alignment.

In addition to the at least one front edge stop 61 and/or the light source 35 relating to the alignment of the front edge 18 of loading aid 04, the light source 37 that produces alignment aid 24, which serves as the outer boundary for the position of the right lateral edge 48 of loading aid 04, for example, and/or that produces alignment aid 27, which serves as the outer boundary for the position of the left lateral edge 49 of loading aid 04, is provided on crossbar 68. The latter are fixed in position, for example, in a lateral region of crossbar 68, to delimit the outermost lateral position.

Figure 10:
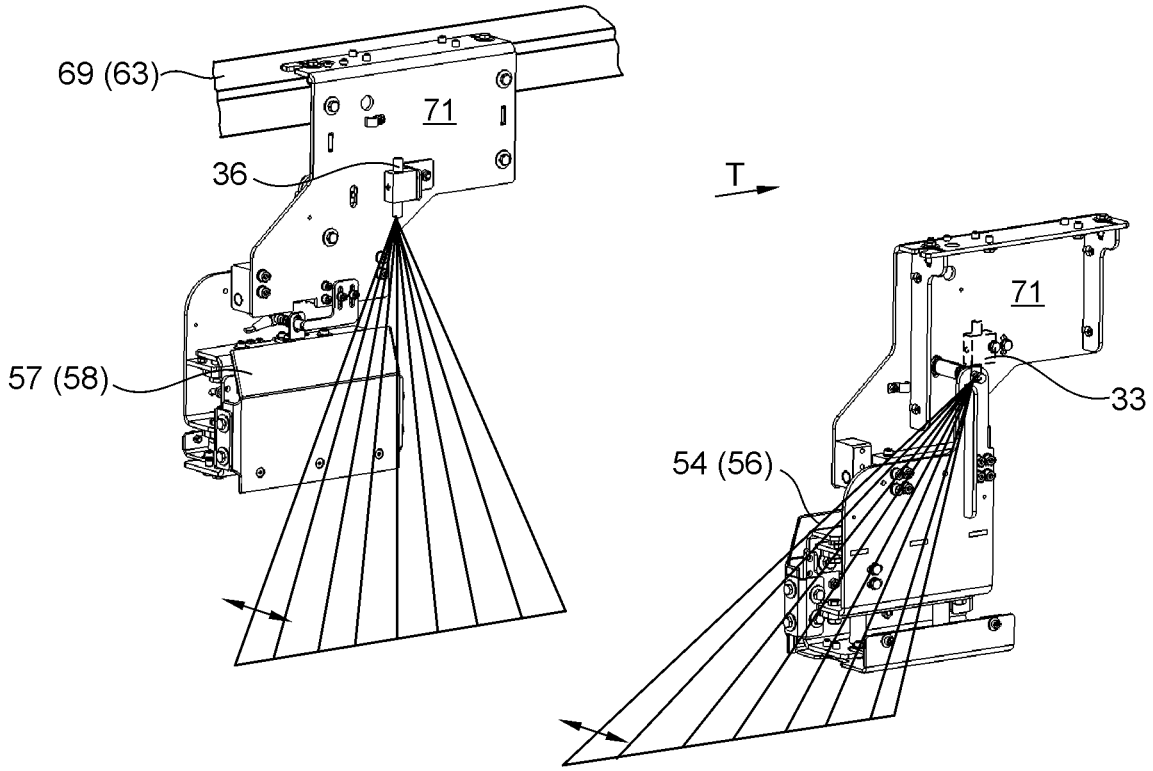
FIG. 10 shows a detailed view of an upper middle part of a pile delivery, with light sources and with the light beam path indicated for alignment aids formed by light projections.
Figure 11:
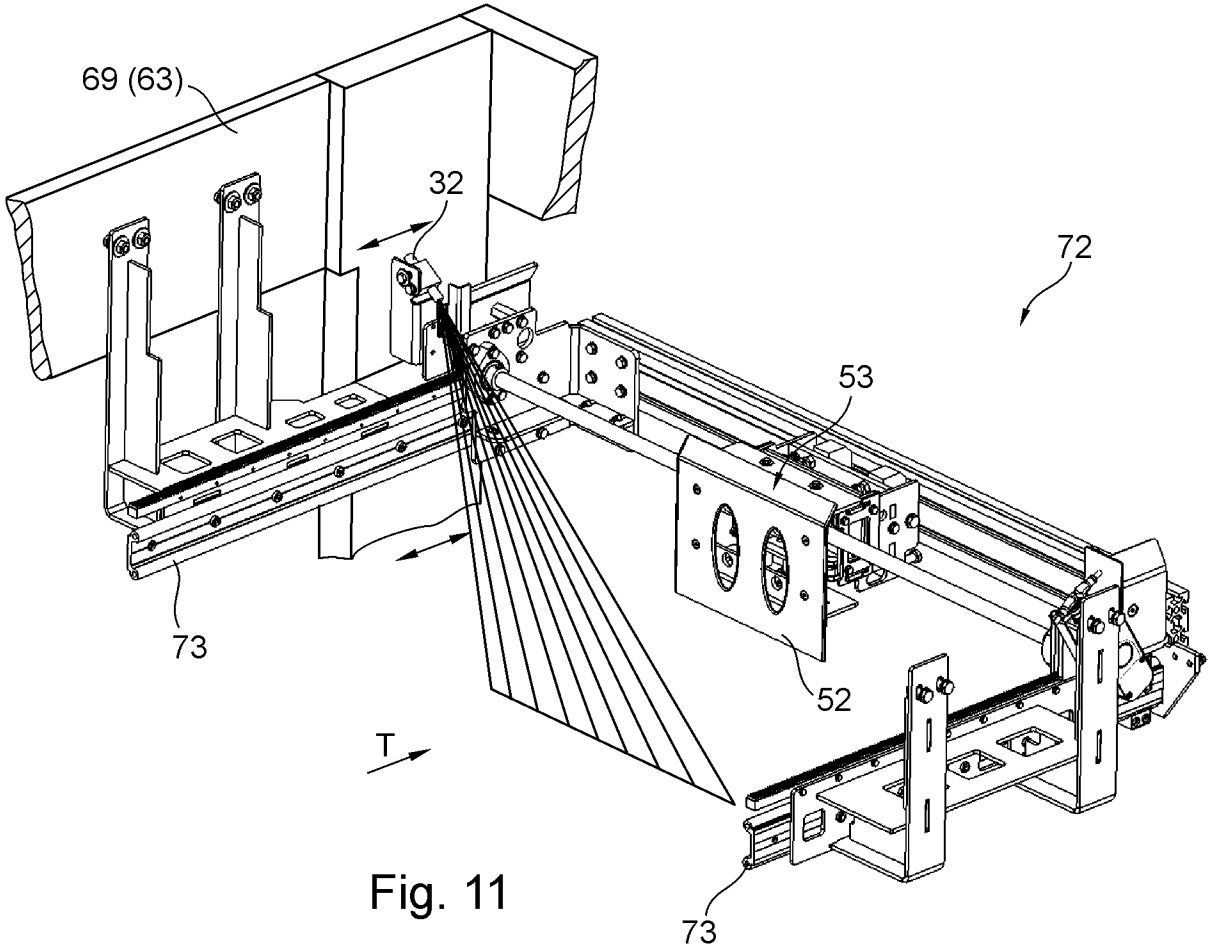
FIG. 11 shows a detailed view of a rear upper part of a pile delivery, with a light source and with the light beam path indicated for an alignment aid formed by light projection.

The light source 33; 36 that produces the transversely movable alignment aid 23, which serves to align the right lateral edge 48 of loading aid 04, and/or that produces the transversely movable alignment aid 26, which serves to align the right lateral edge 49 of loading aid 04, is provided, for example, via a frame-fixed mount 71, on a longitudinal member 69, which is part of the frame 63 (see, e.g., FIG. 10).

Rear edge stop 52 may be arranged, together with the light source 32 of an aforementioned alignment aid 22, on a subframe 72 that is movable on frame 63 in the transport direction T. For example, said subframe 72 is mounted movably on bilateral rails 73, and can be moved by drive means 42, which is not shown in FIG. 11 (see, e.g., FIG. 11).

Figure 12:
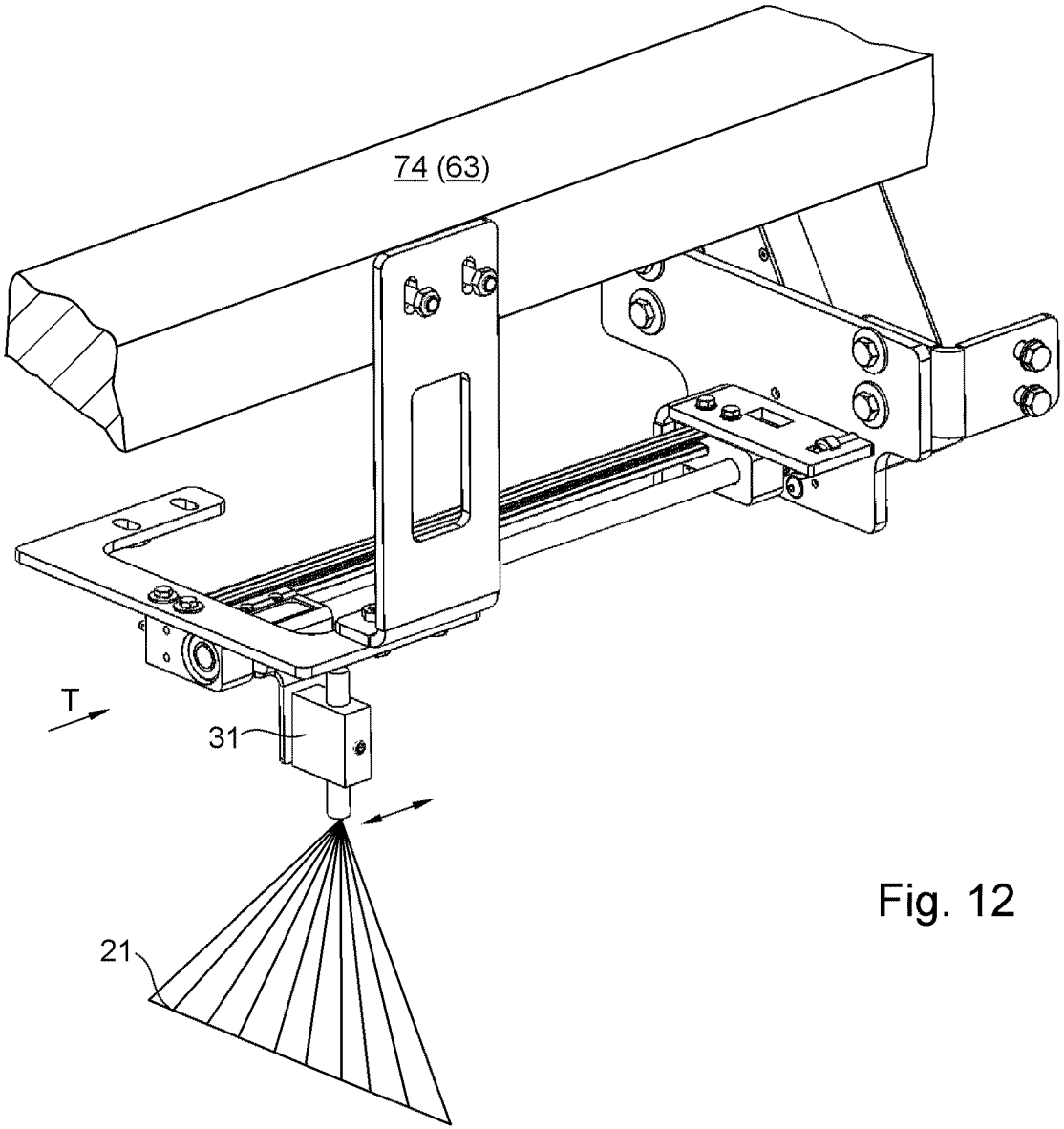
FIG. 12 shows a detailed view of a rear upper part of a pile delivery with light source and with the light beam path indicated for an alignment aid formed by a light projection.

In place of the aforementioned light source 32 that is moved along with rear edge stop 52, or preferably in addition thereto, the light source 31 that is used for the variable positioning of rear loading aid edge 19 is arranged movably in the transport direction T on frame 63, for example on an auxiliary support bar 74 (see, e.g., FIG. 12).

As described above, at least stop means 52; 54; 57; 61 on at least one pile side 28; 29; 48; 49 is mounted on frame 63 such that it can be raised in its entirety, or at least a lower part thereof can be raised, at least slightly, i.e., for example, by at least 3 mm, in particular at least 5 mm, in relation to the position it occupied previously in the contact-free state. Advantageously, at least the front or rear stop means and the left or right stop means 52; 54; 57; 61 is/are movable in its/their entirety, or a lower part thereof can be moved. In an embodiment that is particularly advantageous with respect to the variety of pile forming options, the front, the rear, the left, and the right stop means 52; 54; 57; 61 is/are each mounted such that it is/they are movable vertically, each in its/their entirety or with a lower part, relative to frame 63. This is illustrated by way of example for a multi-part front edge stop 61 (see, e.g., FIG. 13), in which case, e.g., an upper part 61.1 of stop means 61 is mounted in a frame-fixed (but optionally adjustable) manner, but the lower part 61.2 is mounted so as to be vertically movable and/or upwardly yielding. If the stop means 52; 54; 57; 61 in question is configured as one integral part or as multiple rigidly connected parts, it can be mounted so as to be vertically movable in its entirety on the frame 63. The multi-part embodiment of front edge stop 61 that comprises an upper frame-fixed part 61.1 and a lower part 61.2 can be applied accordingly to one or more of the remaining stop means 52; 54; 57.

Figure 13:
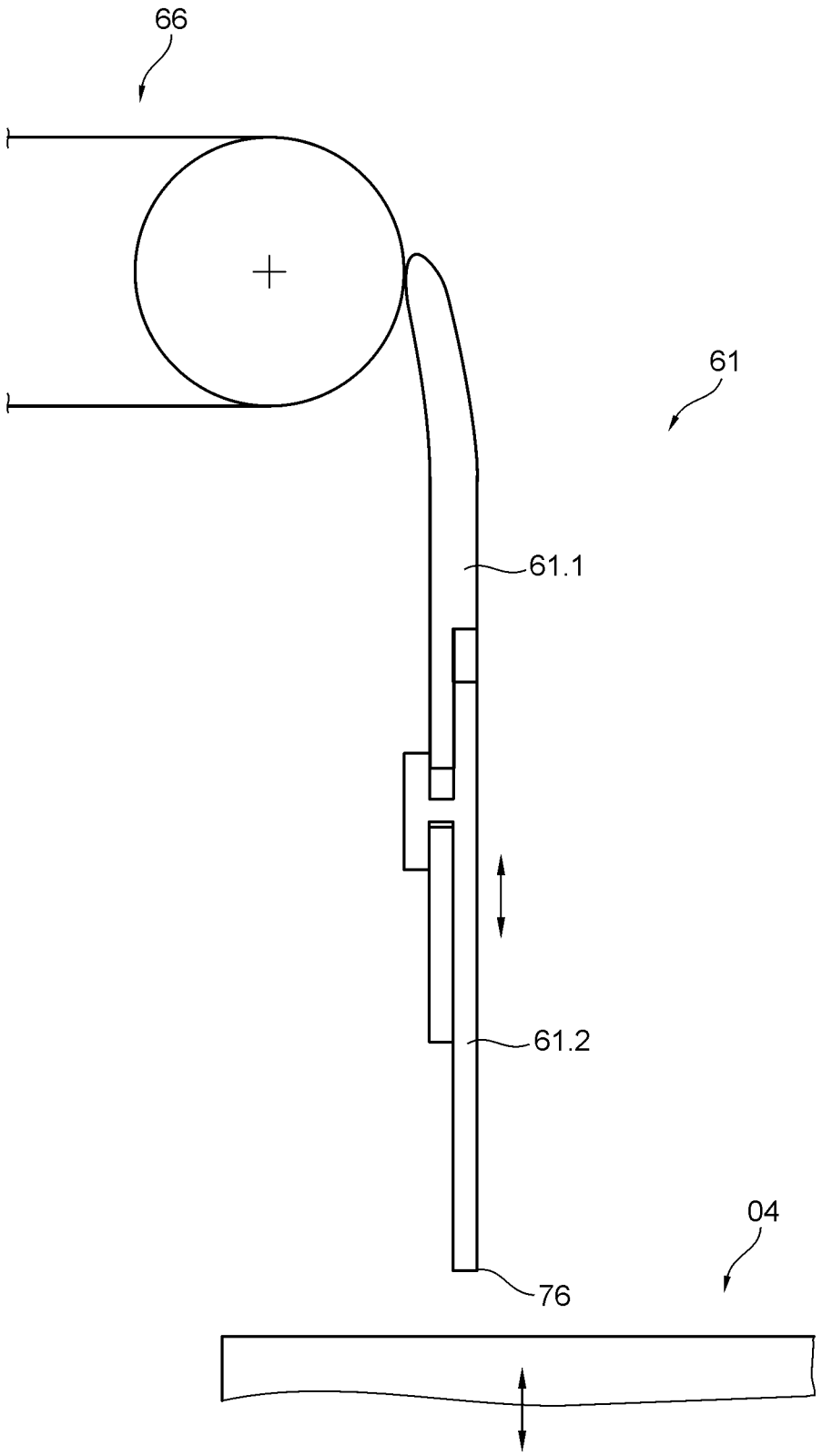
FIG. 13 shows a schematic sectional view of a multi-part stop means, the lower part of which is vertically movable.

As indicated in FIG. 13, by way of example, for a front edge stop 61, and likewise for the remaining, in particular vertically movable stop means 52; 54; 57; 61, on at least one, in particular vertically movable longitudinal section of the stop means 52; 54; 57; 61, the horizontally extending longitudinal edge 76 between the stop surface that faces the pile 06; 06'; 06" and the bottom side is configured as sharp-edged, e.g., as having a maximum radius of curvature of 1.0 mm, in particular at most 0.5 mm, preferably at most 0.3 mm. Imprecision in pile formation, which can occur in the bottom region, for example, as a result of material sheet edges sliding beneath the stop means 52; 54; 57; 61, can thereby be avoided. Such sharp longitudinal edges 76 are preferably provided as the inner lower edge of front edge stop 61, i.e., the edge facing the stacking space, and the inner lower edge of at least one rear edge stop 52 and/or of at least one lateral edge stop 54; 57.

Independently, in principle, of the aforementioned assisted positioning, and/or independently of the setting of loading aid 04 against a stop means 52; 54; 56; 62, but preferably in conjunction therewith, loading aid 04, as indicated above, is configured as a standard or uniform pallet 04 of a fixed format, which is and/or is intended to be used for different material sheet formats.

Figure 14:
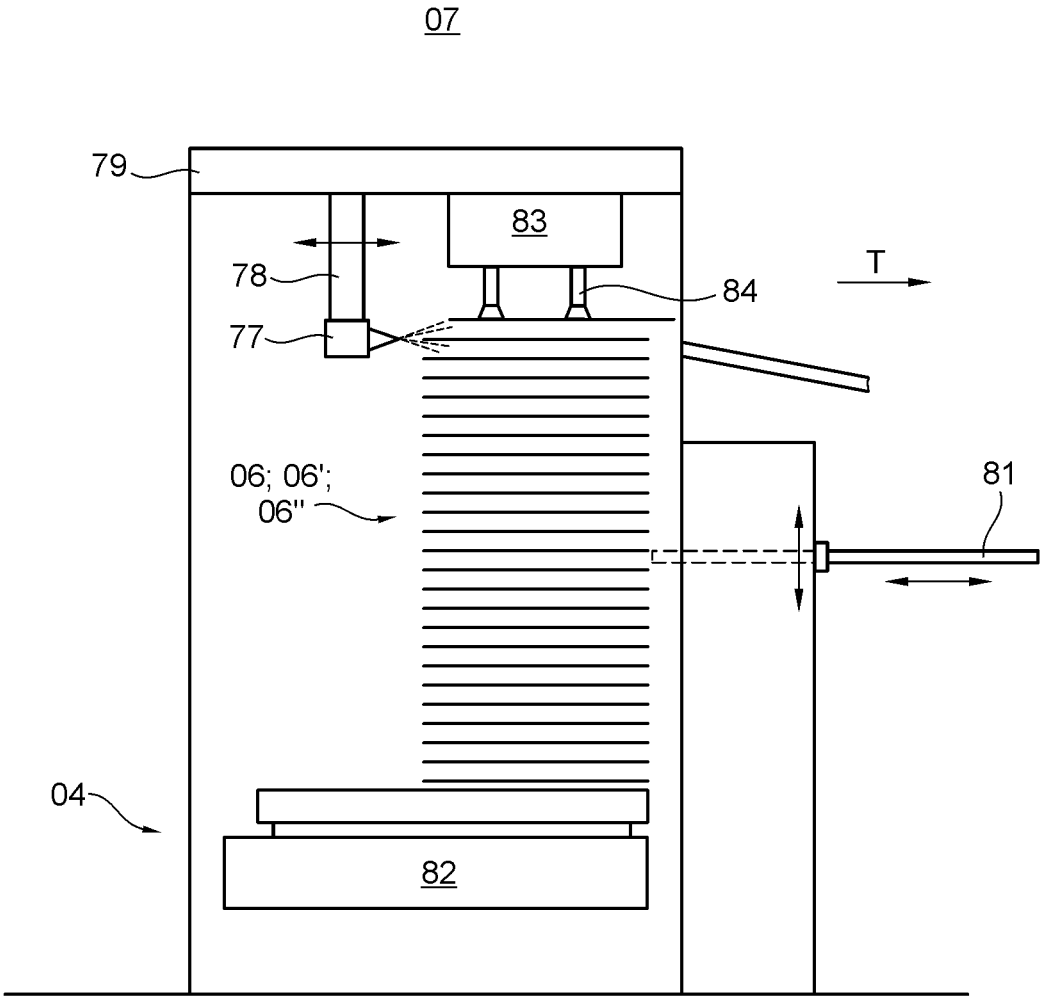
FIG. 14 shows a schematic side view of a material infeed system.

A container comprising a loading aid 04 of this type, configured as a standard pallet 04 on which a pile 06; 06'; 06" that has a smaller format length than the pallet 04 is arranged, is to be fed, for example, on the intake side to a first or a further processing stage, e.g., a printing and/or coating machine 11. This is preferably done via pile feeder 07, illustrated schematically in FIG. 1 and shown enlarged, e.g., in FIG. 14. Material sheets 02 are removed from pile 06; 06'; 06" by a conveyor system 83, e.g., comprising a rocking gripper 84, and are fed into the machine 11 for treatment and/or processing.

Assigned to pile feeder 07 is a separation aid, for example, having a separation tool 77 that assists in separation, which engages from the upstream side of the pile, as viewed in the transport direction T, in an upper region of pile 06; 06'; 06". Such a separation tool 77 may be in the form of a blower device, a mechanical separation aid, or a combination thereof, for example. Preferably, a plurality of separation tools 77 of different types and/or a plurality of separation tools 77 of the same type are provided side by side transversely to the transport direction T. The separation tool or tools 77 can be arranged on a mount 78 and can be mounted movably in the transport direction T relative to a frame 79 of pile feeder 07.

In place of or in addition to the separation device, a device for carrying out a completely interruption-free or at least particularly rapid pile change, comprising, for example, a vertically movable auxiliary support means 81, e.g., also referred to as auxiliary pile carrier 81, may be provided. Said auxiliary support device can be moved, preferably along the transport direction T, into and back out of the cross-sectional area of an adjacent pile 06; 06'; 06". Once auxiliary support means 81 has been moved, for example, between loading aid 04 and the bottommost layer of the pile 06; 06'; 06" supported thereon, beneath the latter, the loading aid 04, if necessary supported by a vertically movable support means 82, e.g., a pile carrier 82, can be lowered and removed. A new pile 06; 06'; 06" can then be loaded and placed below the lower end of the previous pile 06; 06'; 06", before finally, auxiliary pile carrier 81 is moved back out of the pile cross-section.

Independently, in principle, of the above embodiments for the horizontal and/or vertical positioning of loading aid 04 or of the pile 06; 06'; 06" on the same, but advantageously, in particular, in conjunction with these, an advantageous loading aid 04 for receiving a pile 06; 06'; 06" of material sheets 02 to be transported, having a substructure 15 and a superstructure 16, positioned on the substructure 15 and configured to hold the pile 06; 06'; 06" on its upper surface, comprises over its length or at least over a longitudinal section, a plurality of support elements 46; 86, side by side, extending parallel to one another in the longitudinal direction and spaced from one another by gaps 47; 87 that run in the longitudinal direction, wherein in the two lateral edge regions of loading aid 04, on the upper surface thereof, at least one gap 47 is provided, the gap width s1 of which is smaller than a gap 87 that lies in a center region between said edge regions.

This allows a separation tool 77 to engage from above in the center region, for example, and/or minimizes folding of the lateral material sheet edge in the lateral edge region when the material sheet format is narrower than the loading aid format. In addition to or in place of this, the greater gap width s2 in the center region also enables a savings in terms of material and weight.

In a center region of loading aid 04 or the upper surface thereof, or over at least the longitudinal section, a plurality of gaps 87, e.g., at least three or preferably six or even more, having the same greater gap width s2, and on each of the two sides, a plurality of gaps 47, e.g., at least two or preferably three or even more, having the same smaller gap width s1 are preferably provided.

The greater gap width s2 and/or the gap width s2 of the gap 87 lying in the center region is preferably at least 50 mm, in particular at least 80 mm.

Preferably, over the entire length of loading aid 04 or over at least the longitudinal section that comprises the gap 47; 87, the greater gap width s2 or the gap width s2 of the gap 87 lying in the center region is accompanied by a gap depth h of at least 20 mm, advantageously at least 30 mm, preferably at least 40 mm.

The smaller gap width s1 or the gap width s1 of the gap 47 lying in the lateral edge region is preferably accompanied by a gap depth h of at least 10 mm. In one advantageous embodiment, the gap depths h of the wider and narrower gaps 47; 87 may be the same.

The gap width s2 of the at least one gap 87 lying in the center region is greater than the width b1; b2 of the upper surface of an adjoining support element 46; 86.

Figure 15:
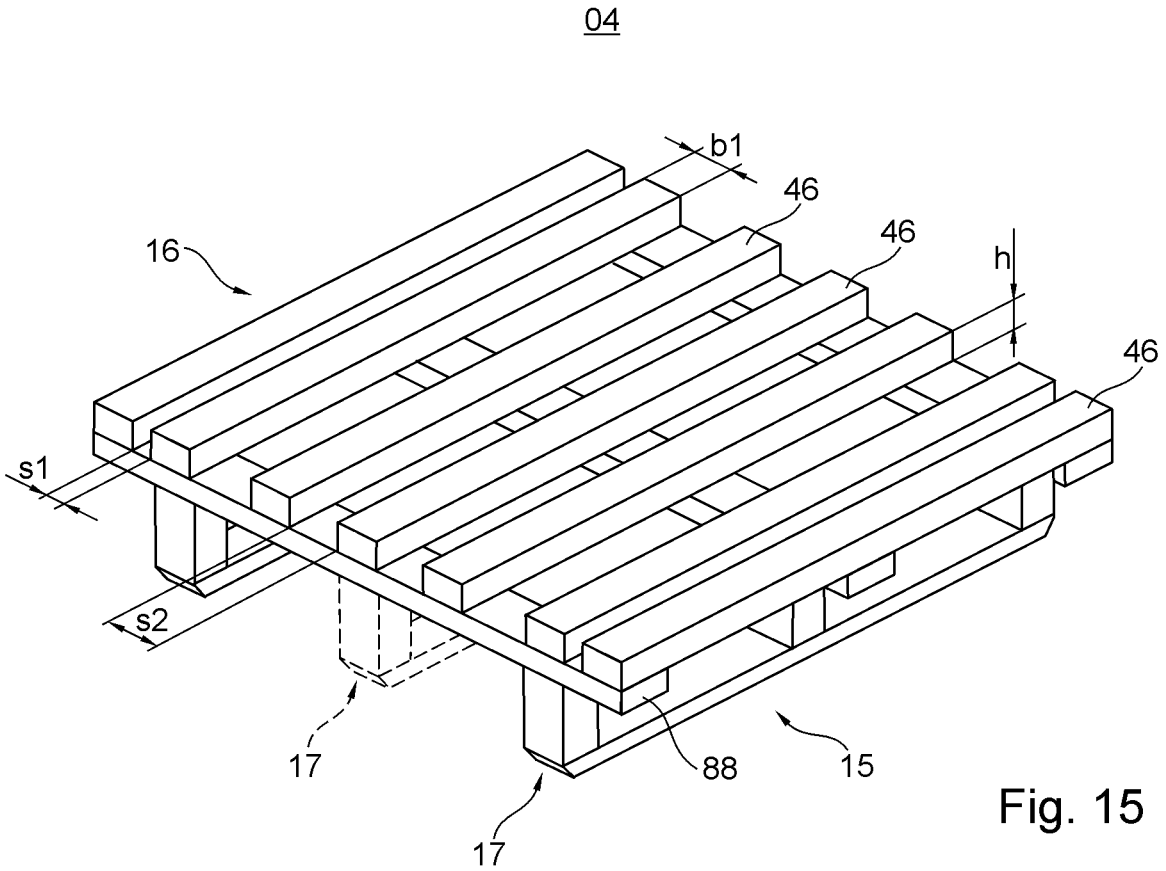
FIG. 15 shows an oblique view of a loading aid in a first, multi-part embodiment, by way of example.
Figure 16:
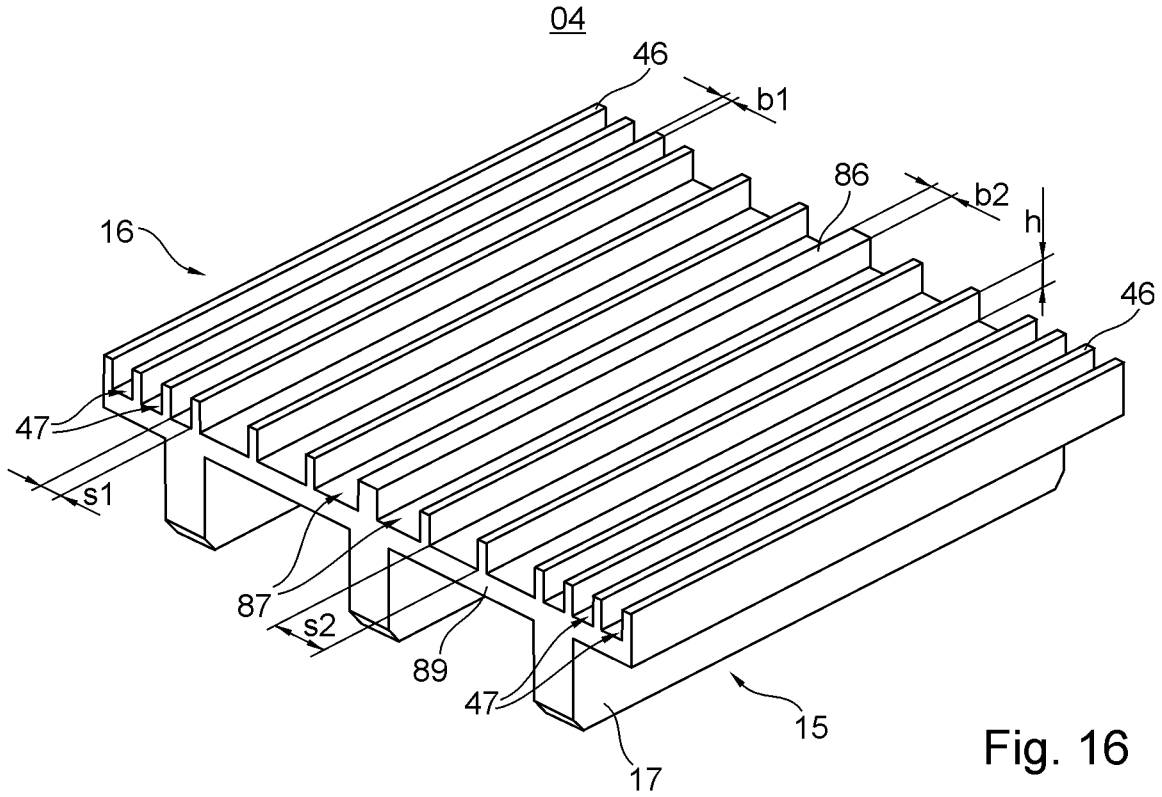
FIG. 16 shows an oblique view of a loading aid in a second, single-part embodiment, by way of example.

Support elements 46; 86 are formed, for example, by crosspieces 46; 86, extending over the length of loading aid 04, which in a first advantageous embodiment (see, e.g., FIG. 15) are in the form of ribs 46; 86, for example, on a plurality of cross-members 88 that are spaced apart from one another in the longitudinal direction, or in another advantageous embodiment (see, e.g., FIG. 16) are arranged on a bottom panel 89 that extends over the length.

For the second embodiment, the crosspieces 46; 86 may be positively or materially connected to the bottom panel 89 or may be produced integrally with said panel, for example from plastic. In addition, for this latter embodiment the substructure 15 may also be integrally produced with bottom panel 89.

For the embodiments that include bottom panel 89, the gaps 47; 87 may also be formed by grooves 47; 87 provided in the bottom panel 89, for example with a closed groove bottom.

In the embodiment involving support elements 46; 86 configured as ribs 46; 86, the gaps 47; 87 may be in the form of spaces 47; 87 between the adjacent ribs 46; 86.

The support elements 45; 86 may be embodied as all having the same width b1, but may also be embodied as having different widths b1; b2.

At least two, but advantageously three bottom runners 17 may be provided. They are in the form of blocks that support the superstructure 16, for example, which are in turn arranged on underlying bottom boards. In an embodiment in which said bottom runners are integral with the superstructure 16, the bottom runners 17 may be solid, or may be provided with openings for the purpose of weight reduction.

For all embodiments and variants, the loading aid 04, in the region of the upper surface for receiving the goods, has a length extending along gap 47; 87, for example, of 800 mm to 1200 mm, in particular 900 mm to 1100 mm, and a width extending transversely thereto of 900 mm to 1300 mm, in particular 1000 mm to 1200 mm. This makes the loading aid particularly suitable for use as a standard or uniform pallet 04, since this format covers the usual material sheet formats.

In said embodiment of loading aid 04 having gaps 47; 87 of different widths, along with all of its variants, said loading aid is particularly advantageously suitable for use in an aforementioned stacking device 01 of a printing and/or coating machine 11, on the intake side of which flat material sheets 02 are conveyed above a stacking space of a pile delivery 03.1; 03.2, which is part of the stacking device 01, and are stacked one on top of the other on a loading aid 04 to form a pile 06; 06'; 06". Preferably, such a loading aid 04 of the same format is then positioned at different locations within the stacking space for two different production runs.

The positioning of loading aid 04 for at least one of the two production runs is preferably assisted by a data processing-based positioning aid, by means of which for the production runs in question, a position specification relating to the target position of loading aid 04 is determined for a drive device that positions a transport means 12 or an alignment aid 21; 22; 23; 24; 25; 26; 27, and positioning is carried out on the basis of said position specification.

Once loading aid 04, configured according to the advantageous embodiment, has been positioned for the subsequent pile formation, it is moved vertically upward at least until it is in physical contact in the region of its upper surface with the lower edge of at least one stop means 52; 54; 57; 61, which aligns the material sheets 02 of the pile 06; 06'; 06" flush along at least one pile side 28; 29; 48; 49 during pile formation. Preferably, said loading aid 04 is moved vertically upward until it raises the at least one stop means 52; 54; 57; 61 at least slightly in relation to the position it occupied previously in the contact-free state.

In the above, pile delivery 03.1; 03.2 or delivery 03.1; 03.2 is understood as a part of the device by means of which, during production, a pile 06 can be formed at said stacking point from the incoming material sheets 02. If sheets are to be stackable selectively on multiple piles 06; 06', multiple such pile deliveries 03.1; 03.2 or deliveries 03.1; 03.2, in particular one behind the other in the transport direction, are or are intended to be arranged, in which case each pile delivery 03.1; 03.2 or delivery 03.1; 03.2 constitutes a stacking point. The stacking space is understood as the space associated with a relevant pile delivery 03.1; 03.2, in which the loading aid 04 to be loaded during stacking at this pile delivery 03.1; 03.2, i.e., at this stacking point, will be or is positioned. In the prior art, such a stacking space is also referred to as a "stacking box" and is used, e.g., during production for receiving precisely one pile 06; 06' to be formed. The above positioning of a pile 06; 06' on a loading aid 04 in different positions relative to the loading aid 04 is thus accomplished by positioning the respective loading aid 04 differently in one and the same stacking space of the same or the sole pile delivery 03.1; 03.2 or delivery 03.1; 03.2.

While a preferred embodiment of a method and device for stacking flat material sheets, and a device and sheet material printing machine for processing and/or treating material sheets in the form of metal sheets, in accordance with the present invention, has been set forth fully and completely herein above, it will be apparent to one of skill in the art that various changes could be made thereto, without departing from the true spirit and scope of the present invention, which is accordingly to be limited only be the appended claims.

The invention claimed is:

1. A device for stacking flat material metal sheets in a sheet metal printing machine, which sheet metal printing machine includes at least one of a printing unit and a coating unit, the device for stacking flat material metal sheets comprising;

at least one pile delivery having a stacking space, above which stacking space incoming flat material metal sheets received from the sheet metal printing machine can be conveyed by a conveyor system in a sheet transport direction and can be deposited in the stacking space in the at least one pile delivery, one on top of the other, to form a pile of the flat material metal sheets;

a pile carrier that is movable vertically within the stacking space;

a front stop for aligning the incoming flat material metal sheets flush along an upstream side of the pile of the flat material metal sheets during the formation of the pile of the flat material metal sheets in the stacking space;

a rear stop for aligning the incoming flat material metal sheets flush along a downstream side of the pile of flat material metal sheets during the formation of the pile of the flat material metal sheets;

a loading aid, which loading aid is movably positionable on an upper surface of the pile carrier and, on which loading aid the pile of the flat material metal sheets to be formed can be received;

a loading aid positioning aid having alignment aids, which alignment aids are usable for positioning the loading aid on the pile carrier one of in and transverse to a transport direction of the flat material metal sheets, which positioning aid is usable to define a location of the loading aid selectively in a first position on the pile carrier in the stacking space, in which first position a downstream edge of the loading aid is aligned substantially vertically with the rear stop, as viewed along the transport direction in a second position in the stacking space, in which second position an upstream edge of the loading aid is aligned substantially vertically with the front, as viewed along the transport direction.

2. The device according to claim 1, wherein the loading aid, which is movably positioned on the pile carrier, is longer, as viewed in the transport direction, than a maximum distance to be set between the rear stop and the front stop, and wherein the loading aid is positioned on the pile carrier in such that, in the first position of the loading aid, as defined by the positioning aid, an upstream edge of the loading aid protrudes upstream beyond a vertical alignment with the front stop, and in the second position of the loading aid, as defined by the positioning aid, a downstream edge of the loading aid protrudes downstream beyond a vertical alignment with the rear stop.

3. The device according to claim 1, one of wherein the first position of the loading aid can be defined by one of a first alignment aid, and the second position of the loading aid can be defined by the first alignment aid, which first alignment aid is movable along the transport direction and by a second alignment aid, which second alignment aid is offset from the first alignment aid along the transport direction and wherein a horizontally positionable one of a mechanical stop and an optical indicator, which can be positioned in a horizontal direction by, is provided as at least one of the one of the first and second alignment aids.

4. The device according to claim 1, wherein the positioning aid comprises a data processor in which a data processing program is run, an output side of the data processor being in signal communication with a drive for positioning an alignment aid for the loading aid, and, on an intake side, the data processor being in signal communication with an interface, via which interface information relating to one of a required position of the pile of the flat material metal sheets on the loading aid and information relating to a format of the flat material metal sheets to be stacked and information from position data stored for a planned production run and pile location can be supplied to the positioning aid.

5. The device according to claim 1, wherein a loading aid downstream edge positioning aid light source, focused in the direction of a support plane of the loading aid, is provided, a light projection from the loading aid downstream edge positioning aid light source forming an optical alignment aid in the support plane of the loading aid and which light projection is usable for positioning the loading aid downstream edge.

6. The device according to claim 1, one of wherein the front stop is mounted fixed relative to a frame of the device for stacking flat material metal sheets, along the direction of transport under operating conditions of the device, and wherein the rear stop is adjustable along the transport direction under operating conditions of the device, to adjust to the stacking of different material format lengths, wherein, above the stacking space, a conveyor system, which is embodied as an overhead transport system for conveying the flat material metal sheets, is provided, and wherein a length of the vertically movable pile carrier is greater, as viewed in the transport direction, than a distance or to be set under operating conditions between the front and the rear stops for deposition, and wherein a loading plane of the vertically movable pile carrier, as viewed in the transport direction, protrudes on at least an upstream side of the vertically movable pile carrier beyond a vertical alignment of a stop surface of the front stop that is usable for aligning the flat material metal sheets flush along an upstream pile side during pile formation.

7. The device according to claim 1, wherein a loading aid lateral edge positioning aid light source, focused in the direction of a support plane of the loading aid, is provided, a light projection from the loading aid lateral edge positioning aid light source forming an optical alignment aid in the support plane of the loading aid and which light projection is usable for positioning a loading aid lateral edge.

* * * * *